US006977139B2

(12) United States Patent
Hasberg et al.

(10) Patent No.: US 6,977,139 B2
(45) Date of Patent: Dec. 20, 2005

(54) THERMALLY DEVELOPABLE MATERIALS CONTAINING ORGANIC SILVER SALTS WITH ROD-LIKE MORPHOLOGY AND METHOD OF MAKING AND USING

(75) Inventors: Dirk J. Hasberg, Rochester, NY (US); Chaofeng Zou, Maplewood, MN (US)

(73) Assignee: Eastman Kodak Company, Rochester, NY (US)

( * ) Notice: Subject to any disclaimer, the term of this patent is extended or adjusted under 35 U.S.C. 154(b) by 12 days.

(21) Appl. No.: 10/826,417

(22) Filed: Apr. 16, 2004

(65) Prior Publication Data

US 2005/0233268 A1 Oct. 20, 2005

(51) Int. Cl.[7] ..... G03C 1/735
(52) U.S. Cl. ..... 430/567; 430/139; 430/348; 430/350; 430/618
(58) Field of Search ..... 430/567, 618, 430/139, 348, 350

(56) References Cited

U.S. PATENT DOCUMENTS

| | | | | |
|---|---|---|---|---|
| 4,704,345 | A | 11/1987 | Hirai et al. | 430/203 |
| 6,268,118 | B1 | 7/2001 | Iwasaki et al. | 430/619 |
| 6,426,181 | B2 | 7/2002 | Irving et al. | 430/620 |
| 6,548,236 | B1 | 4/2003 | Irving et al. | 430/505 |
| 6,576,414 | B1 | 6/2003 | Irving et al. | 430/619 |
| 6,630,293 | B1 * | 10/2003 | Kuno et al. | 430/620 |

FOREIGN PATENT DOCUMENTS

| | | |
|---|---|---|
| EP | 1 132 767 A2 | 9/2001 |
| GB | 1173426 | 12/1996 |
| JP | 02-34370 | 8/1990 |

* cited by examiner

*Primary Examiner*—Hoa Van Le
(74) *Attorney, Agent, or Firm*—J. Lanny Tucker

(57) ABSTRACT

Thermally developable materials such as thermographic and photothermographic materials include a novel non-photosensitive source of reducible silver ions that are predominantly provided as rod-shaped particles of silver salt of a nitrogen-containing heterocyclic compound containing an imino group. The rod-shaped particles have an average aspect ratio of at least 3:1 and a width index for particle diameter of 1.25 or less, and provide improved imaging properties. These particles can be prepared using double jet precipitation procedures in which vAg is kept constant at a value of equal to or greater than −50 mV.

39 Claims, 3 Drawing Sheets

THERMALLY DEVELOPABLE MATERIALS CONTAINING ORGANIC SILVER SALTS WITH ROD-LIKE MORPHOLOGY AND METHOD OF MAKING AND USING

FIELD OF THE INVENTION

This invention relates to high-speed thermally developable materials such as thermographic and photothermographic materials containing organic silver salts having rod-like morphology. It also relates to methods of forming images with reduced haze. In addition, it relates to a method of making particles of silver salts of compounds having an imino group having rod-like morphology.

BACKGROUND OF THE INVENTION

Silver-containing photothermographic imaging materials (that is, thermally developable photosensitive imaging materials) that are imaged with actinic radiation and then developed using heat and without liquid processing have been known in the art for many years. Such materials are used in a recording process wherein an image is formed by imagewise exposure of the photothermographic material to specific electromagnetic radiation and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image by the reduction of silver ions that are in catalytic proximity to silver halide-grains bearing the silver-containing clusters of the latent image. This produces a black-and-white image. The non-photosensitive silver source is catalytically reduced to form the visible black-and-white negative image while much of the silver halide, generally, remains as silver halide and is not reduced. In most instances, the source of reducible silver ions is an organic silver salt in which silver ions are complexed with organic silver coordinating ligands.

Thermographic materials are similar in nature except that the photocatalyst is omitted and imaging and development are carried out simultaneously using a thermal imaging means. Such materials also include an organic silver salt that provides reducible silver ions required for imaging.

Differences Between Photothermography and Photography

The imaging arts have long recognized that the field of photo-thermography is clearly distinct from that of photography. Photothermographic materials differ significantly from conventional silver halide photographic materials that require processing with aqueous processing solutions.

In photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, in Zou et al., *J Imaging Sci. Technol.* 1996, 40, pp. 94–103, and in M. R. V. Sahyun, *J. Imaging Sci. Technol.* 1998, 42, 23.

Problem to be Solved

As noted above, non-photosensitive sources of reducible silver ions are critical to the imaging mechanism of both photothermographic and thermographic materials. Various organic silver salts are useful for this purpose including silver carboxylates (both aliphatic and aromatic), silver salts of nitrogen-containing heterocyclic compounds, silver sulfonates, and many others known in the art as described for example in U.S. Pat. No. 6,576,410 (Zou et al.).

Aqueous-based photothermographic materials have been known for many years in which the imaging components and binders are formulated in and coated from solvents comprising primarily water. It has been necessary in designing such materials that the various imaging components be compatible with water and other water-soluble or -dispersible components. Silver benzotriazole has been found particularly useful in aqueous-based materials because of the hydrophilic nature of silver benzotriazole crystal surfaces and its compatability with most water-soluble binders.

Since crystals of silver benzotriazole are non-photosensitive in thermally developable materials and are not removed from minimum density areas after the thermal development process, the particle size of useful silver salts (such as silver benzotriazole) should be sufficiently small that light scattering is eliminated or minimized. A desirable organic silver salt crystal should also have good thermal stability at ambient temperature but exhibit high thermal development reactivity at elevated temperature when catalyzed by silver metal in the presence of a reducing agent.

While silver benzotriazole has been described as useful in thermally developable materials in various publications, there has been no detailed description of its micro-crystal growth. The art simply describes precipitations of silver benzotriazole particles in a non-controlled fashion with no defined crystal morphology. The resulting precipitated particles are usually very large in size and generally produce unacceptable haze in the resulting images. Additional processes (for example homogenization or milling) have been used to reduce particle size for commercial usefulness in thermally developable imaging layers.

GB 1,173,426 (Fuji) describes a process for silver benzotriazole salt precipitation in two solvent mixtures but the crystal morphology is not identified. U.S. Pat. No. 4,704,345 (Hirai et al.) describes the preparation of silver benzotriazole in an aqueous gelatin solution using a single-jet introduction of a silver nitrate solution into a benzotriazole solution. The exact preparatory conditions and the resulting silver salt particle size or morphology are not described. JP Kokai 2-34370 (Masukawa et al.) describes the single-jet introduction of a methanol solution of benzotriazole into an aqueous silver nitrate solution without identifying particle size and morphology of the resulting silver benzotriazole salt particles.

There is a need for organic silver salts, especially silver benzotriazoles, that have the desired particle size and morphological purity that render them more useful in thermally developable materials and provide images with reduced haze.

SUMMARY OF THE INVENTION

The present invention provides a thermally developable material comprising a support and having therein at least one thermally developable imaging layer comprising a hydrophilic polymer binder or a water-dispersible polymer latex binder and in reactive association:

a. a non-photosensitive source of reducible silver ions, and b. a reducing agent for the reducible silver ions, wherein the non-photosensitive source of reducible silver ions are predominantly provided as rod-shaped particles of a silver salt of a nitrogen-containing heterocyclic compound containing an imino group, the rod-shaped particles having an average aspect ratio of at least 3:1 and a width index for particle diameter of 1.25 or less.

In addition, this invention provides a black-and-white photothermographic material comprising a support and having therein at least one thermally developable imaging layer comprising a hydrophilic polymer binder or a water-dispersible polymer latex binder and in reactive association:

a. a photosensitive silver halide, b. a non-photosensitive source of reducible silver ions, and c. a reducing agent for the reducible silver ions, wherein the non-photosensitive source of reducible silver ions are particles of one or more organic silver salts provided that at least 70% by number of the particles are rod-shaped particles of a silver salt of a nitrogen-containing heterocyclic compound containing an imino group, the rod-shaped particles having an average aspect ratio of at least 3:1 and a width index for particle diameter of 1.25 or less.

In preferred embodiments, this invention provides a black-and-white photothermographic material comprising a support having on a frontside thereof, a) one or more frontside thermally developable imaging layers comprising a hydrophilic polymer binder or a water-dispersible polymer latex binder, and in reactive association, a photosensitive silver bromide, silver iodobromide, or a mixture thereof, b) a non-photosensitive source of reducible silver ions that includes a silver salt of benzotriazole or a derivative thereof, and c) a reducing agent for the non-photosensitive source reducible silver ions, the material comprising on the backside of the support, one or more backside thermally developable imaging layers having the same or different composition as the frontside thermally developable imaging layers, and d) optionally, an outermost protective layer disposed over the one or more thermally developable imaging layers on either or both sides of the support, and the silver salt of benzotriazole or a derivative thereof comprising rod-shaped particles that have a length of from about 0.1 to about 0.5 $\mu$m, a diameter less than 0.1 $\mu$m, an aspect ratio of from about 4 to about 7.5, and a width index for particle diameter of from about 1.1 to about 1.2.

This invention also provides a method of forming a visible image comprising:

A) imagewise exposing the photothermographic material of this invention to form a latent image, B) simultaneously or sequentially, heating the exposed photothermographic material to develop the latent image into a visible image.

Thermographic materials of this invention can be developed in an imagewise fashion using any suitable thermal imaging means.

In some embodiments, wherein the thermally developable material comprises a transparent support, the image-forming method further comprises:

C) positioning the exposed and thermally-developed material with the visible image therein between a source of imaging radiation and an imageable material that is sensitive to the imaging radiation, and D) exposing the imageable material to the imaging radiation through the visible image in the exposed and thermally-developed material to provide an image in the imageable material.

The method of this invention is preferably used for medical diagnosis.

This invention also provides an imaging assembly comprising a photothermographic material of this invention that is arranged in association with one or more phosphor intensifying screens.

In addition, the present invention provides a method of making particles of a silver salt of a nitrogen-containing heterocyclic compound containing an imino group, comprising:

A) preparing aqueous solution A of a nitrogen-containing heterocyclic compound containing an imino group, B) preparing aqueous solution B of silver nitrate, and C) simultaneously adding the aqueous solutions A and B to a reaction vessel containing an aqueous dispersion of a hydrophilic polymer binder or a water-dispersible polymer latex binder that has a pH of from about 7.5 to about 10, the simultaneous addition of said aqueous solutions A and B being carried out at constant flow rates $A_1$ and B1, respectively, for up to 240 minutes, while maintaining a constant temperature of from about 30 to about 75° C., a constant pH, and a constant vAg equal to or greater than −50 mV in the reaction vessel, thereby preparing in the reaction vessel an organic silver salt dispersion of the hydrophilic polymer binder or the water-dispersible polymer latex binder and rod-shaped particles of a silver salt of the nitrogen-containing heterocyclic compound containing an imino group, the particles having an average aspect ratio of at least 3:1 and a width index for particle diameter of 1.25 or less, and the hydrophilic polymer binder or the water-dispersible polymer latex binder being present in the organic silver salt dispersion in an amount of from about 2 to about 10 weight %.

In preferred embodiments, a method of making a silver salt of silver benzotriazole, comprises:

A) preparing aqueous solution A of benzotriazole,

B) preparing aqueous solution B of silver nitrate, and

C) simultaneously adding aqueous solutions A and B to a reaction vessel containing an aqueous dispersion of gelatin or a gelatin derivative that has a pH of from about 8 to about 9.5, the simultaneous addition of aqueous solutions A and B being carried out at constant flow rates $A_1$ and $B_1$, respectively, for up to 60 minutes, while maintaining a constant temperature of from about 40 to about 60° C., a constant pH, and a constant vAg that is equal to or greater than 0 mV in the reaction vessel, D) increasing the flow rate of the addition of solution B to the reaction vessel to $B_2$ for up to 60 minutes while maintaining constant temperature, pH, and vAg in the reaction vessel, wherein the ratio of the flow rate $B_2$ to the flow rate $B_1$ is from about 1.4:1 to about 1.8:1, and E) subsequently increasing the flow rate of the addition of solution B to the reaction vessel to $B_3$ for up to 60 minutes while maintaining constant temperature, pH and vAg in the reaction vessel, wherein the ratio of the flow rate $B_3$ to the flow rate $B_2$ is from about 1.8:1 to about 2.2:1, thereby preparing in the reaction vessel an organic silver salt dispersion of the gelatin or gelatin derivative and rod-shaped particles of silver benzotriazole having a width index for diameter of from about 1.1 to about 1.2, an average aspect ratio of from about 4:1 to about 7.5:1, and a diameter of less than or equal to 0.07 $\mu$m, and the gelatin or gelatin derivative being present in the organic silver salt dispersion in an amount of from about 2 to about 10 weight %.

This invention further provides an organic silver salt dispersion of a hydrophilic polymer binder or a water-dispersible polymer latex binder and rod-shaped particles of a non-photosensitive silver salt of a nitrogen-containing heterocyclic compound containing an imino group, the particles having an average aspect ratio of at least 3:1 and a width index for particle diameter of 1.25 or less, and the hydrophilic polymer binder or the water-dispersible polymer latex binder being present in the organic silver salt dispersion in an amount of from about 2 to about 10 weight %.

In preferred embodiments of the present invention, a non-photosensitive silver salt of a nitrogen-containing heterocyclic compound containing an imino group is in the form of rod-shaped particles having an average aspect ratio of at least 3:1, a width index for particle diameter of about 1.2 a diameter less than or equal to 0.1 $\mu$m, and a length that is less than 1 $\mu$m.

The present invention provides a method for preparing organic silver salts such as silver benzotriazole with desired morphological properties defined by particle size and aspect ratio. We have discovered that fine, rod-shaped particles of organic silver salts (such as silver benzotriazole) provided by this invention lead to superior sensitometric properties. They can be prepared with a desired morphological purity (aspect ratio) and particle size using a double-jet procedure in which pH and vAg are controlled in the aqueous dispersion. In particular, the vAg is controlled during nucleation at a value equal to or greater than −50 mV to provide these results.

The resulting organic silver salt particles can be used to provide high-speed thermally developable materials that provide images with high $D_{max}$ and low $D_{min}$. Coatings of these silver salt particles exhibit less haze and therefore provide sharper images.

DETAILED DESCRIPTION OF THE INVENTION

Figure 1:
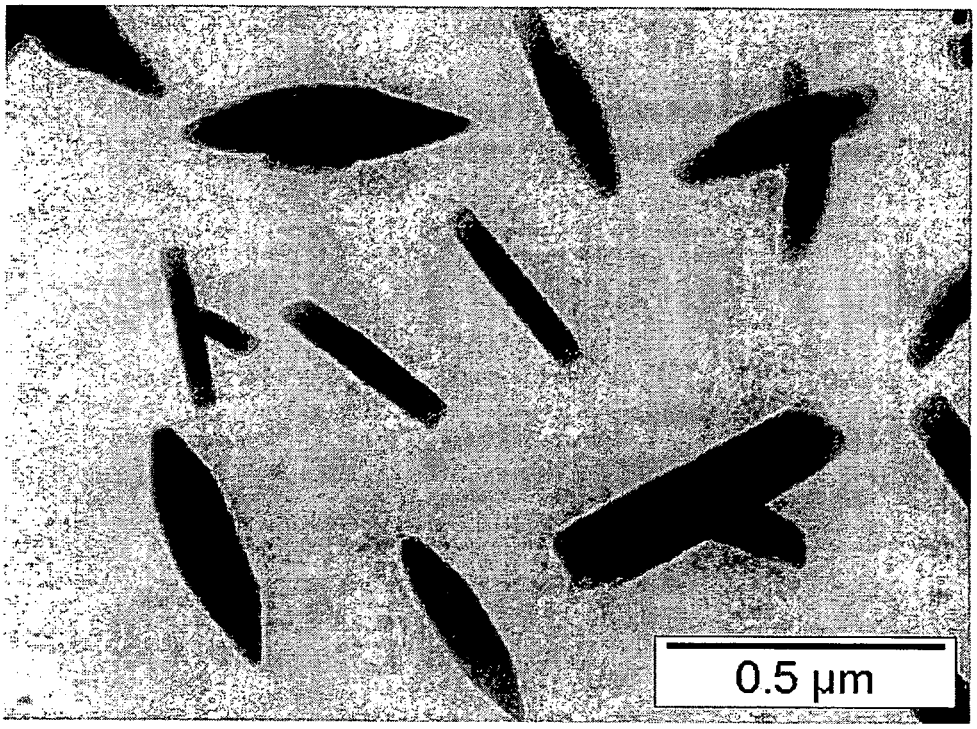
FIG. 1 is a black-and-white photograph of highly magnified silver benzotriazole particles prepared as Comparative Dispersion A in Example 1.

The thermally developable materials of this invention can be used in black-and-white or color photothermography and in electronically generated black-and-white or color hard-copy recording. They can be used in microfilm applications, in radiographic imaging (for example digital medical imaging), X-ray radiography, and in industrial radiography. Furthermore, the absorbance of these materials between 350 and 450 nm is desirably low (less than 0.5), to permit their use in the graphic arts area (for example, imagesetting and phototypesetting), in the manufacture of printing plates, in contact printing, in duplicating ("duping"), and in proofing.

The photothermographic materials of this invention are particularly useful for medical imaging of human or animal subjects in response to visible or X-radiation for use in medical diagnosis. Such applications include, but are not limited to, thoracic imaging, mammography, dental imaging, orthopedic imaging, general medical radiography, therapeutic radiography, veterinary radiography, and auto-radiography. When used with X-radiation, the photothermographic materials of this invention may be used in combination with one or more phosphor intensifying screens, with phosphors incorporated within the photothermographic emulsion, or with a combination thereof.

The photothermographic materials of this invention can be made sensitive to radiation of any suitable wavelength. Thus, in some embodiments, the materials are sensitive at ultraviolet, visible, near infrared, or infrared wavelengths, of the electromagnetic spectrum. In these embodiments, the materials are preferably sensitive to radiation greater than 100 nm (such as sensitivity to, from about 100 nm to about 750 nm). In other embodiments they are sensitive to X-radiation. Increased sensitivity to X-radiation can be imparted through the use of phosphors.

The photothermographic materials of this invention are also useful for non-medical uses of visible or X-radiation (such as X-ray lithography and industrial radiography). In these and other imaging applications, it is particularly desirable that the photothermographic materials be "double-sided."

In some embodiments of the thermally developable materials of this invention, the components needed for imaging can be in one or more imaging or emulsion layers on one side ("frontside") of the support. The layer(s) that contain the photosensitive photocatalyst (such as a photosensitive silver halide) for photothermographic materials or the non-photosensitive source of reducible silver ions, or both, are referred to herein as the emulsion layer(s). In photothermographic materials, the photocatalyst and non-photosensitive source of reducible silver ions are in catalytic proximity and preferably are in the same emulsion layer.

Where the materials contain imaging layers on one side of the support only, various non-imaging layers can also be disposed on the "backside" (non-emulsion or non-imaging side) of the materials, including, conductive layers, antihalation layer(s), protective layers, antistatic layers, and transport enabling layers.

In such instances, various non-imaging layers can also be disposed on the "frontside" or imaging or emulsion side of the support, including protective topcoat layers, primer layers, interlayers, opacifying layers, antistatic layers, antihalation layers, acutance layers, auxiliary layers, and other layers readily apparent to one skilled in the art.

For some embodiments it may be useful that the thermally developable materials be "double-sided" or "duplitized" and have the same or different emulsion coatings (or thermally developable layers) on both sides of the support. Such constructions can also include one or more protective topcoat layers, primer layers, interlayers, antistatic layers, acutance layers, antihalation layers, auxiliary layers, conductive layers, anti-crossover layers, and other layers readily apparent to one skilled in the art on either or both sides of support.

When the materials of this invention are heat-developed as described below in a substantially water-free condition after, or simultaneously with, imagewise exposure, a silver image (preferably a black-and-white silver image) is obtained.

Definitions

As used herein:

In the descriptions of the thermally developable materials of the present invention, "a" or "an" component refers to "at least one" of that component (for example, the organic silver salts).

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a construction comprising at least one photothermographic emulsion layer or a photothermographic set of emulsion layers (wherein the photosensitive silver halide and the source of reducible silver ions are in one layer and the other essential components or desirable additives are distributed, as desired, in the same layer or in an adjacent coated layer. These materials also include multilayer constructions in which one or more imaging components are in different layers, but are in "reactive association." For example, one layer can include the non-photosensitive source of reducible silver ions and another layer can include the reducing agent and/or photosensitive silver halide.

"Thermographic material(s)" can be similarly constructed but are intentionally non-photosensitive (thus no photosensitive silver halide is intentionally added).

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

When used in thermography, the term, "imagewise exposing" or "imagewise exposure" means that the material is imaged using any means that provides an image using heat. This includes, for example, analog exposure where an image is formed by differential contact heating through a mask using a thermal blanket or infrared heat source, as well as by digital exposure where the image is formed one pixel at a time such as by modulation of a thin film thermal printhead or by heating with a scanning laser beam.

The thermographic materials of this invention are "direct" thermo-graphic materials and thermal imaging is carried out in a single thermographic material containing all of the necessary imaging chemistry. Direct thermal imaging is distinguishable from what is known in the art as thermal transfer imaging (such as dye transfer imaging) in which the image is produced in one material ("donor") and transferred to another material ("receiver") using thermal means.

"Catalytic proximity" or "reactive association" means that the materials are in the same layer or in adjacent layers so that they readily come into contact with each other during thermal imaging and development.

"Emulsion layer," "imaging layer," or "photothermographic (or thermographic) emulsion layer," means a layer of a photothermographic (or thermographic) material that contains the photosensitive silver halide (not present in thermographic materials) and/or non-photosensitive source of reducible silver ions. It can also mean a layer of the material that contains, in addition to the photosensitive silver halide and/or non-photosensitive source of reducible ions, additional essential components and/or desirable additives such as the reducing agent(s). These layers are usually on what is known as the "frontside" of the support but they can be on both sides of the support.

In addition, "frontside" also generally means the side of a thermally developable material that is first exposed to imaging radiation, and "backside" generally refers to the opposite side of the thermally developable material.

"Photocatalyst" means a photosensitive compound such as silver halide that, upon exposure to radiation, provides a compound that is capable of acting as a catalyst for the subsequent development of the thermally developable material.

Many of the materials used herein are provided as a solution. The term "active ingredient" means the amount or the percentage of the desired material contained in a sample. All amounts listed herein are the amount of active ingredient added.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 nm to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

"Transparent" means capable of transmitting visible light or imaging radiation without appreciable scattering or absorption.

The sensitometric term "absorbance" is another term for optical density (OD).

The sensitometric terms "photospeed," "speed," or "photographic speed" (also known as sensitivity), absorbance, contrast, Dmin, and Dmax have conventional definitions known in the imaging arts. In photothermographic materials, Dmin is considered herein as image density achieved when the photothermographic material is thermally developed without prior exposure to radiation. It is the average of eight lowest density values on the exposed side of the fiducial mark. In thermographic materials, Dmin is considered herein as the image density in the areas with the minimum application of heat by the thermal printhead.

In photothermographic materials, the term Dmax is the maximum image density achieved when the photothermographic material is exposed to a particular radiation source and a given amount of radiation energy and then thermally developed. In thermographic materials, the term Dmax is the maximum image density achieved when the thermographic material is thermally imaged with a given amount of thermal energy.

The terms "density," "optical density (OD)," and "image density" refer to the sensitometric term absorbance.

"Speed-2" is Log1/E+4 corresponding to the density value of 1.0 above Dmin where E is the exposure in ergs/cm$^2$.

"Speed-3" is Log1/E+4 corresponding to the density value of 2.9 above Dmin where E is the exposure in ergs/cm$^2$.

"Imaging discrimination" is the difference between Dmax and Dmin (Dmax-Dmin). It is the difference in density after development between the highest density region and the non-exposed region.

"Width index" is a measure of particle size distribution within a defined range [See, T. Allen, *Particle Size Measurement, Vol I*, Chapman & Hall, London, UK, 1997, p. 54]. As used herein, the width index is determined from the 14$^{th}$, 50$^{th}$, and 86$^{th}$ percentile of the cumulative frequency distribution for the characteristic particle dimension under consideration, defined by the following formula:

$$\frac{[(50\text{ percentile}/14\text{ percentile}) + (86\text{ percentile}/50\text{ percentile})]}{2}$$

Using this formula, an emulsion of completely monodisperse particles would have a width index of one.

Speed-2/Dmin is a measure of the relative speed for samples having a wide range of Dmin values.

As used herein, the phrase "organic silver coordinating ligand" refers to an organic molecule capable of forming a bond with a silver atom. Although the compounds so formed are technically silver coordination compounds they are also often referred to as silver salts.

In the compounds described herein, no particular double bond geometry (for example, cis or trans) is intended by the structures drawn unless otherwise specified. Similarly, in compounds having alternating single and double bonds and localized charges their structures are drawn as a formalism. In reality, both electron and charge delocalization exists throughout the conjugated chain.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of, or as "a derivative" of, a given formula, any substitution that does not alter the bond structure of the formula or the shown atoms within that structure is included within the formula, unless such substitution is specifically excluded by language.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3—CH_2—CH_2—O—CH_2—$ and $CH_3—CH_2—CH_2—S—CH_2—$), hydroxyalkyl (such as 1,2-dihydroxyethyl), haloalkyl, nitroalkyl, alkylcarboxy, carboxyalkyl, carboxamido, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

The photothermographic materials of the present invention include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred silver halides, with the latter silver halide having up to 10 mol % silver iodide based on total silver halide.

In some embodiments, higher amounts of iodide may be present in the photosensitive silver halide grains up to the saturation limit of iodide as described in copending and commonly assigned U.S. Ser. No. 10/246,265 (filed Sep. 18, 2002 by Maskasky and Scaccia).

The shape (morphology) of the photosensitive silver halide grains used in the present need not be limited. The silver halide grains may have any crystalline habit including cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed. Silver halide grains having cubic and tabular morphology (or both) are preferred. More preferably, the silver halide grains are predominantly (at least 50% based on total silver halide) present as tabular grains.

The silver halide grains may have a uniform ratio of halide throughout. They may have a graded halide content, with a continuously varying ratio of, for example, silver bromide and silver iodide or they may be of the core-shell type, having a discrete core of one or more silver halides, and a discrete shell of one of more different silver halides. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

In some instances, it may be helpful to prepare the photosensitive silver halide grains in the presence of a hydroxytetraazaindene or an N-heterocyclic compound comprising at least one mercapto group as described in U.S. Pat. No. 6,413,710 (Shor et al.), that is incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halide grains be preformed and prepared by an ex-situ process, and then be added to and physically mixed with the non-photosensitive source of reducible silver ions.

It is also possible to form the source of reducible silver ions in the presence of ex-situ-prepared silver halide. In this process, the source of reducible silver ions, such as a silver salt of an imino compound, is formed in the presence of the preformed silver halide grains. Co-precipitation of the reducible source of silver ions in the presence of silver halide provides a more intimate mixture of the two materials [see, for example U.S. Pat. No. 3,839,049 (Simons)] to provide a "preformed emulsion."

It is also effective to use an in-situ process in which an inorganic halide- or an organic halogen-containing compound is added to an organic silver salt to partially convert the silver of the organic silver salt to silver halide as described in U.S. Pat. No. 3,457,075 (Morgan et al.).

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), JP Kokai 49-013224, (Fuji), JP Kokai 50-017216 (Fuji), and JP Kokai 51-042529 (Fuji).

In general, the non-tabular silver halide grains used in this invention can vary in average diameter of up to several micrometers ($\mu$m) and they usually have an average particle size of from about 0.01 to about 1.5 $\mu$m (preferably from about 0.03 to about 1.0 $\mu$m, and more preferably from about 0.05 to about 0.8 $\mu$m). The average size of the photosensitive silver halide grains is expressed by the average diameter if the grains are spherical, and by the average of the diameters of equivalent circles for the projected images if the grains are cubic, tabular, or other non-spherical shapes. Representative grain sizing methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2.

In most preferred embodiments of this invention, the silver halide grains are provided predominantly (based on at least 50 mol % silver) as tabular silver halide grains that are considered "ultrathin" and have an average thickness of at least 0.02 $\mu$m and up to and including 0.10 $\mu$m (preferably an average thickness of at least 0.03 $\mu$m and more preferably of at least 0.04 $\mu$m, and up to and including 0.08 $\mu$m and more preferably up to and including 0.07 $\mu$m).

In addition, these ultrathin tabular grains have an equivalent circular diameter (ECD) of at least 0.5 $\mu$m (preferably at least 0.75 $\mu$m, and more preferably at least 1 $\mu$m). The ECD can be up to and including 8 $\mu$m (preferably up to and including 6 $\mu$m, and more preferably up to and including 4 $\mu$m).

The aspect ratio of the useful tabular grains is at least 5:1 (preferably at least 10:1, and more preferably at least 15:1) and generally up to 50:1.

The grain size of ultrathin tabular grains may be determined by any of the methods commonly employed in the art for particle size measurement, such as those described above.

The ultrathin tabular silver halide grains can also be doped using one or more of the conventional metal dopants known for this purpose including those described in

*Research Disclosure* item 38957, September, 1996 and U.S. Pat. No. 5,503,970 (Olm et al.), incorporated herein by reference. Preferred dopants include iridium (III or IV) and ruthenium (II or III) salts. Particularly preferred silver halide grains are ultrathin tabular grains containing iridium-doped azole ligands. Such tabular grains and their method of preparation are described in copending and commonly assigned U.S. Ser. No. 10/825,708 (filed on Apr. 16,2004 by Olm et al.) entitled "Silver Halide Emulsion Containing Iridium Dopant" that is incorporated herein by reference.

The one or more light-sensitive silver halides used in the photothermographic materials of the present invention are preferably present in an amount of from about 0.005 to about 0.5 mole (more preferably from about 0.01 to about 0.25 mole, and most preferably from about 0.03 to about 0.15 mole) per mole of non-photosensitive source of reducible silver ions.

Chemical Sensitizers

If desired, the photosensitive silver halides used in photothermographic materials of this invention can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process,* Fourth Edition, Eastman Kodak Company, Rochester, N.Y., 1977, Chapter 5, pp. 149–169. Suitable conventional chemical sensitization procedures and compounds are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), U.S. Pat. No. 6,296,998 (Eikenberry et al), EP 0 915 371 A1 (Lok et al.), and U.S. Pat. No. 5,691,127 (Daubendiek et al.) all incorporated herein by reference.

Certain substituted or and unsubstituted thioureas can be used as chemical sensitizers including those described in U.S. Pat. No. 6,296,998 (Eikenberry et al.) and U.S. Pat. No. 6,322,961 (Lam et al.), U.S. Pat. No. 4,810,626 (Burgmaier et al.), and U.S. Pat. No. 6,368,779 (Lynch et al.), all of the which are incorporated herein by reference.

Still other useful chemical sensitizers include tellurium- and selenium-containing compounds that are described in and U.S. Pat. No. 5,158,892 (Sasaki et al.), U.S. Pat. No. 5,238,807 (Sasaki et al.), U.S. Pat. No. 5,942,384 (Arai et al.) U.S. Pat. No. 6,620,577 (Lynch et al.), and U.S. Pat. No. 6,699,647 (Lynch et al.), all of which are incorporated herein by reference.

Noble metal sensitizers for use in the present invention include gold, platinum, palladium and iridium. Gold (+1 or +3) sensitization is particularly preferred, and described in U.S. Pat. No. 5,858,637 (Eshelman et al.) and U.S. Pat. No. 5,759,761 (Lushington et al.). Combinations of gold(III) compounds and either sulfur- or tellurium-containing compounds are useful as chemical sensitizers and are described in U.S. Pat. No. 6,423,481 (Simpson et al.). All of the above references are incorporated herein by reference.

In addition, sulfur-containing compounds can be decomposed on silver halide grains in an oxidizing environment according to the teaching in U.S. Pat. No. 5,891,615 (Winslow et al.). Examples of sulfur-containing compounds that can be used in this fashion include sulfur-containing spectral sensitizing dyes.

Other useful sulfur-containing chemical sensitizing compounds that can be decomposed in an oxidized environment are the diphenylphosphine sulfide compounds represented by the Structure (PS) described in more detail in copending and commonly assigned U.S. Ser. No. 10/731,251 (filed Dec. 9, 2003 by Simpson, Burleva, and Sakizadeh), which application is incorporated herein by reference.

The chemical sensitizers can be used in making the silver halide emulsions in conventional amounts that generally depend upon the average size of silver halide grains. Generally, the total amount is at least $10^{-10}$ mole per mole of total silver, and preferably from about $10^{-8}$ to about $10^{-2}$ mole per mole of total silver. The upper limit can vary depending upon the compound(s) used, the level of silver halide, and the average grain size and grain morphology.

Spectral Sensitizers

The photosensitive silver halides used in the photothermographic features of the invention may be spectrally sensitized with one or more spectral sensitizing dyes that are known to enhance silver halide sensitivity to ultraviolet, visible, and/or infrared radiation of interest. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in chemical finishing of the photothermographic emulsion, but are generally added after chemical sensitization.

Suitable sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al), U.S. Pat. No. 5,441,866 (Miller et al.), U.S. Pat. No. 5,508,162 (Dankosh), U.S. Pat. No. 5,510,236 (Dankosh), U.S. Pat. No. 5,541,054 (Miller et al.), JP Kokai 2000-063690 (Tanaka et al.), JP Kokai 2000-112054 (Fukusaka et al.), JP Kokai 2000-273329 (Tanaka et al.), JP Kokai 2001-005145 (Arai), JP Kokai 2001-064527 (Oshiyama et al.), JP Kokai 2001-154305 (Kita et al.), and *Research Disclosure*, item 308119, Section IV, December, 1989. All of these publications are incorporated herein by reference.

Teachings relating to specific combinations of spectral sensitizing dyes also provided in U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.), all of which are incorporated herein by reference.

Also useful are spectral sensitizing dyes that decolorize by the action of light or heat as described in U.S. Pat. No. 4,524,128 (Edwards et al.), JP Kokai 2001-109101 (Adachi), JP Kokai 2001-154305 (Kita et al.), and JP 2001-183770 (Hanyu et al.), all of which are incorporated herein by reference.

Dyes may be selected for the purpose of supersensitization to attain much higher sensitivity than the sum of sensitivities that can be achieved by using each dye alone.

An appropriate amount of spectral sensitizing dye added is generally about $10^{-10}$ to $10^{-1}$ mole, and preferably, from about $10^{-7}$ to $10^{-2}$ mole per mole of silver halide.

Non-Photosensitive Source of Reducible Silver Ions

The "primary" non-photosensitive source of reducible silver ions used in the thermally developable materials of this invention includes one or more organic silver salts of nitrogen-containing heterocyclic compounds containing an imino group. Such silver(I) salts are comparatively stable to light and form a silver image when heated to 50° C. or higher in the presence of an exposed silver halide (for photothermographic materials) and a reducing agent. These salts are also used in thermographic materials where they directly participate in thermal image formation.

Representative primary organic silver salts include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazole and imidazole derivatives as described in U.S. Pat. No. 4,260,677 (Winslow et al.). Particularly useful primary silver salts are the silver salts of benzotriazole, substituted derivatives thereof, or mixtures of two or more of these salts. A silver salt of benzotriazole is most preferred in the thermally developable materials of this invention.

While the noted primary organic silver salts are the predominant silver salts in the materials, secondary organic silver salts can be used if present in "minor" amounts (less than 40 mol % based on the total moles of organic silver salts).

Such secondary organic silver salts include silver salts of heterocyclic compounds containing mercapto or thione groups and derivatives thereof such as silver triazoles, oxazoles, thiazoles, thiazolines, imidazoles, diazoles, pyridines, and triazines as described in U.S. Pat. No. 4,123,274 (Knight et al.) and U.S. Pat. No. 3,785,830 (Sullivan et al.). Examples of other useful silver salts of mercapto or thione substituted compounds that do not contain a heterocyclic nucleus include silver salts of thioglycolic acids, dithiocarboxylic acids, and thioamides. Silver salts of organic acids including silver salts of long-chain aliphatic or aromatic carboxylic acids may also be included as secondary silver salts.

Secondary organic silver salts can also be core-shell silver salts as described in U.S. Pat. No. 6,355,408 (Whitcomb et al.), that is incorporated herein by reference wherein a core has one or more silver salts and a shell has one or more different silver salts. Other secondary organic silver salts can be silver dimer compounds that comprise two different silver salts as described in U.S. Pat. No. 6,566,045 (Whitcomb) that is incorporated herein by reference.

Still other useful secondary silver salts are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in copending and commonly assigned U.S. Published Application 2004-0023164 (Bokhonov et al.) that is incorporated herein by reference.

The primary organic silver salts useful in this invention are prepared in a unique manner to give them a desired rod-shaped morphology that provides a number of useful properties. In particular, the primary organic silver salts are provided predominantly (at least 50%, and preferably at least 70%, by number of all particles of the same silver salt) as rod-like particles having an aspect ratio of at least 3:1 and preferably an aspect ratio of from about 3 to about 10 (more preferably from about 4 to about 7.5).

In addition, the distribution of primary organic silver salt particles in an emulsion formulation is relatively uniform in size as defined by a width index for particle diameter of 1.25 or less, and preferably from about 1.1 to about 1.2.

The particles of the primary organic silver salts generally have a diameter of less than or equal to 0.1 $\mu$m and a length that is less than 1 sum. Preferably, the particles have a diameter of from about 0.03 to about 0.07 $\mu$m and a length of from about 0.1 to about 0.5 $\mu$m.

Thus, most preferred primary organic silver salt particles are composed of silver benzotriazole or a derivative thereof (or mixture of such silver salts) that have an aspect ratio of from about 4 to about 7.5, a width index for grain diameter of from about 1.1 to about 1.2, a length of from about 0.1 to about 0.3 $\mu$m, and a diameter of from about 0.04 to about 0.06 $\mu$m.

The one or more non-photosensitive sources of reducible silver ions (both primary and secondary organic silver salts) are preferably present in an amount of about 5% by weight to about 70% by weight, and more preferably, about 10% to about 50% by weight, based on the total dry weight of the emulsion layers. Alternatively, the total amount of reducible silver ions is generally present in an amount of from about 0.001 to about 0.2 mol/m$^2$ of the dry thermally developable material (preferably from about 0.01 to about 0.05 mol/m$^2$).

The total amount of silver (from all silver sources) in the photothermographic materials of this invention is generally at least 0.002 mol/m$^2$ and preferably from about 0.01 to about 0.05 mol/m$^2$ for single-sided materials. For double-sided coated materials, total amount of silver from all sources would be doubled. The amount of silver in the thermographic materials of this invention is generally from about 0.01 to about 0.05 mol/m$^2$.

The primary organic silver salts used in this invention are generally prepared using certain conditions and procedure that will provide particles having the rod-shaped morphology described above. Thus, the method of making these silver salt particles is carried out by first preparing an aqueous solution (solution A) of a nitrogen-containing heterocyclic compound containing an imino group. Solution A generally contains from about 0.5 to about 5.0 moles/liter of the nitrogen-containing heterocyclic compound containing an imino group and may also contain one or more bases (such as hydroxides) to adjust the pH. There may be a mixture of organic silver coordinating ligands that react with silver but the noted heterocyclic compounds are the predominant organic silver coordinating ligands.

An aqueous solution (Solution B) of one or more aqueous soluble inorganic silver salts (such as silver nitrate)is also prepared.

A suitable reaction vessel is used to make the primary silver salts. In this vessel is an aqueous solution of from about 2 to about 10 weight % of one or more hydrophilic polymer binders (see below) or water-dispersible hydrophobic polymer binders (in latex form). Suitable bases (such as a hydroxide) may be included to adjust the pH of this vessel solution to from about 7.5 to about 10 (preferably from about 8 to about 9.5).

Solutions A and B are then simultaneously added to the reaction vessel at constant flow rates $A_1$ and $B_1$, respectively, for up to 240 minutes while maintaining a constant pH (generally from about 7.5 to about 10 and preferably from about 8 to about 9.5) and a constant vAg equal to or greater than −50 mV in the reaction vessel. By greater than −50 mV is meant more positive than −50 mV. The vAg is preferably maintained at greater than or equal to 0 mV and more preferably greater than or equal to +50 mV. The flow rate $A_1$ to the total moles of silver precipitated is generally from about 0.004 to about 0.04 mol/min/mol Ag of the imino-group-containing compound per minute and the ratio of flow rate $B_1$ to the total moles of silver precipitated is generally from about 0.004 to about 0.04 mol Ag/min/mol Ag. Optimum flow rates can be readily determined to obtain particles of a desired aspect ratio and size with routine experimentation. The contents of the reaction vessel are generally kept at a constant temperature of from about 30 to about 75° C. and preferably from about 35 to about 55° C.

Either or both of Solutions A and B can be introduced into the reaction vessel at steady flow rates, or at variable flow rates. For example, the flow rate of the addition of solution B can be increased to flow rate $B_2$ for up to 60 minutes while maintaining constant temperature, pH, and vAg in the reaction vessel. The ratio of flow rate $B_2$ to flow rate $B_1$ is from about 1.4:1 to about 1.8:1. A further change in the flow rate of Solution B can also be made by increasing it to flow rate $B_3$ for up to 60 minutes while maintaining constant temperature, pH and vAg in the reaction vessel. The ratio flow rate $B_3$ to flow rate $B_2$ is from about 1.8:1 to about 2.2:1.

The addition of Solutions A and B to the reaction vessel then produces a silver salt dispersion of the hydrophilic polymer binder or the water-dispersible polymer latex binder and rod-shaped particles of the desired organic silver salt(s). The one or more binders are generally present in the silver salt dispersion in an amount preferably of from about 2 to about 10 weight %.

Representative preparatory conditions and procedures are illustrated in Example 1 below.

Reducing Agents

The thermally developable materials of the present invention can include one or more suitable reducing agents that would be apparent to one skilled in the art to reduce silver(I) to metallic silver. Preferably, such reducing agents are ascorbic acid(s) or reductone(s).

An "ascorbic acid" reducing agent (also referred to as a developer or developing agent) means ascorbic acid, complexes thereof, and derivatives thereof. Ascorbic acid reducing agents are described in a considerable number of publications in photographic processes, including U.S. Pat. No. 5,236,816 (Purol et al.) and references cited therein.

Useful ascorbic acid reducing agents include ascorbic acid and the analogues, isomers, complexes, and derivatives thereof. Such compounds include, but are not limited to, D- or L-ascorbic acid, 2,3-dihydroxy-2-cyclohexen-1-one, 3,4-dihydroxy-5-phenyl-2(5H)-furanone, sugar-type derivatives thereof (such as sorboascorbic acid, γ-lactoascorbic acid, 6-desoxy-L-ascorbic acid, L-rhamno-ascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, niacinamide ascorbate, potassium ascorbate, isoascorbic acid (or L-erythroascorbic acid), and salts thereof (such as alkali metal, ammonium or others known in the art), endiolo type ascorbic acid, an enaminol type ascorbic acid, a thioenol type ascorbic acid, and an enamin-thiol type ascorbic acid, as described for example in U.S. Pat. No. 5,498,511 (Yamashita et al.), EP 0 585 792 A1 (Passarella et al.), EP 0 573 700 A1 (Lingier et al.), EP 0 588 408 A1 (Hieronymus et al.), U.S. Pat. No. 5,089,819 (Knapp), U.S. Pat. No. 5,278,035 (Knapp), U.S. Pat. No. 5,384,232 (Bishop et al.), U.S. Pat. No. 5,376,510 (Parker et al.), JP Kokai 7-56286 (Toyoda), U.S. Pat. No. 2,688,549 (James et al.), and *Research Disclosure*, publication 37152, March 1995. Mixtures of these developing agents can be used if desired.

A "reductone" reducing agent means a class of unsaturated, di- or poly-enolic organic compounds which, by virtue of the arrangement of the enolic hydroxyl groups with respect to the unsaturated linkages, possess characteristic strong reducing power. The parent compound, "reductone" is 3-hydroxy-2-oxo-propionaldehyde (enol form) and has the structure HOCH═CH(OH)—CHO. In some reductones, an amino group, a mono-substituted amino group or an imino group may replace one or more of the enolic hydroxyl groups without affecting the characteristic reducing behavior of the compound.

Reductone developing agents are described in a considerable number of publications in photographic processes, including U.S. Pat. No. 2,691,589 (Henn et al), U.S. Pat. No. 3,615,440 (Bloom), U.S. Pat. No. 3,664,835 (Youngquist et al.), U.S. Pat. No. 3,672,896 (Gabrielson et al.), U.S. Pat. No. 3,690,872 (Gabrielson et al.), U.S. Pat. No. 3,816,137 (Gabrielson et al.), U.S. Pat. No. 4,371,603 (Bartels-Keith et al.), U.S. Pat. No. 5,712,081 (Andriesen et al.), and U.S. Pat. No. 5,427,905 (Freedman et al.), all of which references are incorporated herein by reference.

Reductone reducing agents include: 1,3-di-p-tolyl-2,3-dihydroxy-2-propene-1-one, 1,3-dipyridyl-2,3-dihydroxy-2-propene-1-one, 1-phenyl-3-pyridyl-2,3-dihydroxy-2-propene-1-one, 1,3-dithienyl-2,3-dihydroxy-2-propene-1-one, 1-phenyl-3-furyl-2,3-dihydroxy-2-propene-1-one, 1,3-dibenzyl-2,3-dihydroxy-2-propene-1-one, 1,3-dibutyl-2,3-dihydroxy-2-propene-1-one, 1-propyl-3-cyclohexyl-2,3-dihydroxy-2-propene-1-one, 1-propyl-3-(o-methoxyphenyl)-2,3-dihydroxy-2-propene-1-one, 1-(p-chloropyridyl)-3-(2-methoxyethyl)-2,3-dihydroxy-2-propene-1-one, 4,5-dimethyl reductic acid, 4,4-dimethyl-reductic acid, 4-methoxy-reductic acid, 4,5-diethyl-reductic acid, 4,5-di(chloromethyl)-reductic acid, 4-propyl-reductic acid, 4,6-dimethyl-2,3-dihydroxy-cyclohex-2-ene-1-one, 5,5-dimethyl-2,3-dihydroxy-cyclohex-2-ene-1-one, 5-bromo-2,3-dihydroxy-cyclohex-2-ene-1-one, 5-bromo-4,6-dimethyl-2,3-dihydroxy-cyclohex-2-ene-1-one, 5,5-ethyl-2,3-dihydroxy-cyclohex-2-ene-1-one, 5,5-dimethoxy-2,3-dihydroxy-cyclohex-2-ene-1-one, 5-thioethyl-2,3-dihydroxy-cyclohex-2-ene-1-one, 2,3-dihydroxy-cyclohept-2-ene-1-one, 5-methyl-2,3-dihydroxy-cyclohept-2-ene-1-one, 5-methyl-2,3-dihydroxy-cyclohept-2-ene-1-one, 2,3-dihydroxy-cyclobut-2-ene-1-one, 4-butyl-2,3-dihydroxy-cyclobut-2-ene-1-one, and 4,4-dimethyl-2,3-dihydroxy-cyclobut-2-ene-1-one.

In some embodiments, the ascorbic acid compound or reductone compound is represented by Structure (I):

(I)

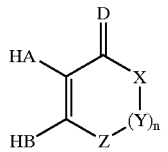

wherein A, B, and D each independently represents O or $NR_7$, X represents O, $NR_8$, $CR_9R_{10}$, C═O, or C═$NR_{11}$, Y represents O, $NR'_8$, $CR'_9R'_{10}$, C═O, or C═$NR'_{11}$, Z represents O, $NR''_8$, $CR''_9R'_{10}$, C═O, or $CNR''_{11}$, and n is 0 or 1.

Moreover, in Structure (I) above, $R_7$, $R_8$, $R_9$, $R_{10}$ and $R'_{11}$, $R'_7$ $R'_8$, $R'_9$, $R'_{10}$, and $R'_{11}$, and $R''_7$ $R''_8$, $R''_9$, $R''_{10}$, and $R''_{11}$, each independently represents hydrogen, an alkyl group (preferably having from 1 to 18 carbon atoms), an aralkyl group (preferably having from 7 to 15 carbon atoms), an alkenyl group (preferably having from 2 to 5 carbon atoms), an alkynyl group (preferably having from 2 to 5 carbon atoms), a cycloalkyl or cycloalkenyl group (preferably having 3 to 7 carbon atoms forming the ring), an aryl group (preferably having 6 to 10 carbon atoms forming one or more aromatic rings), or an aromatic or non-aromatic heterocyclyl group (preferably having 5 or 6 carbon, nitrogen, oxygen, and sulfur atoms forming the aromatic or non-aromatic ring), or $R_9$ and $R_{10}$, $R'_9$ and $R'_{10}$, or $R''_9$ and $R''_{10}$, may further represent the number of atoms necessary to form a saturated or unsaturated carbocyclic or heterocyclic ring (preferably having 5 to 7 atoms within the ring), wherein when X is $CR_9R_{10}$ and Y is $CR'_9R'_{10}$ and $R'_9$ and/or $R_{10}$ and $R'_{10}$ may represent the number of atoms necessary to form a saturated or unsaturated carbocyclic or heterocyclic ring (preferably having 5 to 7 atoms within the ring), and wherein when Y is $CR'_9R_{110}$ and Z is $CR'_9R'_{10}$ and n=1, then $R'_9$ and $R''_9$ and/or $R'_{10}$ and $R''_{10}$ may represent the number of atoms necessary to form a saturated or unsaturated carbocyclic or heterocyclic ring (preferably having 5 to 7 atoms within the ring). All of the noted groups defined in this paragraph can be substituted with one or more substituents that would be readily apparent to a skilled worker in the art. It would also be apparent to a skilled worker in the art that some combinations of X, Y, and Z as defined above are not chemically possible. Thus, a skilled worker would be able to design compounds of Structure I with suitable X, Y, and Z groups that are chemically possible and useful in the practice of the present invention.

In one preferred embodiment, the reducing agent is an ascorbic acid compound or reductone compound represented by Structure (Ia):

(Ia)

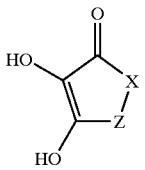

wherein X represents an O, $NR_8$, or $CR_9R_{10}$ group and Z represents $CR''_9$ $R''_{10}$ wherein $R_9$ is hydrogen and $R_{10}$ is a substituted or unsubstituted alkyl group having from 1 to 6 carbon atoms or a substituted or unsubstituted aryl group.

In a more preferred embodiment, X is 0 and Z represents $CR''_9$ $R''_{10}$ wherein $R_9$ is hydrogen and $R_{10}$ is a substituted or unsubstituted alkyl group having from 1 to 6 carbon atoms or a substituted or unsubstituted phenyl group.

Ascorbic acid reducing agents are preferred for use in photothermographic materials, particularly when silver benzotriazole is used as the source of reducible silver ions. Ascorbic acid and 3,4-dihydroxy-5-phenyl-2(5H)-furanone are specifically preferred in such embodiments.

Other useful reducing agents are ascorbic acid compounds (or derivatives) that are described in copending and commonly assigned U.S. Ser. No. 10/764,704 (filed Jan. 26, 2004 by Ramsden, Lynch, Skoug, and Philip), incorporated herein by reference. These reducing agents can be represented by the following Structure (II):

(II)

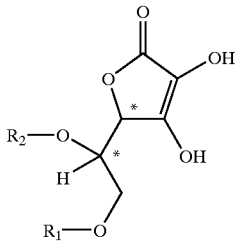

wherein $R_1$ and $R_2$ are independently hydrogen and/or the same or different acyl groups [$R_3$—(C═O)— or $R_3$—L—(C═O)—], provided that $R_1$ and $R_2$ are not both hydrogen. The acyl groups each have 11 or fewer carbon atoms, and preferably each acyl group is branched and/or contains at least one ring. The acyl groups may be substituted with functional groups such as ethers, halogens, esters and amides.

$R_3$ of the acyl group may be hydrogen, or a substituted or unsubstituted alkyl group having 10 or fewer carbon atoms (such as methyl, ethyl, iso-propyl, t-butyl, and benzyl), substituted or unsubstituted aryl having 6 to 10 carbon atoms in the carbocyclic ring (such as phenyl, 4-methylphenyl, 4-methoxyphenyl, and naphthyl), substituted or unsubstituted alkenyl having 10 or fewer carbon atoms in the chain (such as ethenyl, hexenyl, and 1-methylpropenyl), or a substituted or unsubstituted heterocyclic group having 5 to 7 nitrogen, oxygen, sulfur, and carbon atoms in the heterocyclic ring (such as tetrahydrofuryl and benzthiazoyl). L may be oxy, thio, or —$NR_4$—, wherein $R_4$ is defined in the same way as $R_3$.

At least one of $R_1$ and $R_2$ is an acyl group and the other of $R_1$ and $R_2$ is preferably hydrogen. Preferably, $R_3$ is tert-butyl, $R_4$ is hydrogen, and L is nitrogen.

Mixtures of these compounds can be used if desired in any specific proportion.

Compounds of Structure II have two chiral centers (indicated by*) Therefore four isomers are possible and compounds of Structure II may be derived from D- or L-ascorbic acid or from D- or L-isoascorbic acid.

Representative examples of compounds having Structure II are shown below in TABLE I with Compounds I-1, I-2, I-7, and I-9 being preferred.

TABLE I

| Compound | Derived From | $R_1$ | $R_2$ |
|---|---|---|---|
| I-1 | L-ascorbic acid | t-Butyl-(C═O)— | H |
| I-2 | D-isoascorbic acid | t-Butyl-(C═O)— | H |
| I-3 | L-ascorbic acid | t-Butyl-(C═O)— | t-Butyl-(C═O)— |
| I-4 | D-isoascorbic acid | t-Butyl-(C═O)— | t-Butyl-(C═O)— |
| I-5 | D-isoascorbic acid | H | t-Butyl-(C═O)— |
| I-6 | L-ascorbic acid | i-Propyl-(C═O)— | H |
| I-7 | L-ascorbic acid | Ph-(C═O)— | H |
| I-8 | L-ascorbic acid | 1-Adamantyl-(C═O)— | H |
| I-9 | L-ascorbic acid | 1-Adamantylmethyl-(C═O)— | H |

TABLE I-continued

| Compound | Derived From | $R_1$ | $R_2$ |
|---|---|---|---|
| I-10 | L-ascorbic acid | 1-Methylcyclo-hexyl-(C=O)— | H |
| I-11 | L-ascorbic acid | 2-Adamantylmethyl-(C=O) | H |
| I-12 | L-ascorbic acid | 2,2-Dimethylpropyl-(C=O)— | H |
| I-13 | L-ascorbic acid | Cyclohexyl-(C=O)— | H |
| I-14 | L-ascorbic acid | 1,1-Dimethylpropyl-(C=O)— | H |
| I-15 | L-ascorbic acid | 1-Ethylpropyl-(C=O)— | H |
| I-16 | L-ascorbic acid | 2,4,4-Trimethyl-pentyl-(C=O)— | H |
| I-17 | L-ascorbic acid | 2-Methylpropyl-(C=O)— | H |
| I-18 | L-ascorbic acid | Cyclopentyl-(C=O)— | H |
| I-19 | L-ascorbic acid | Diethylamino-(C=O) | H |
| I-20 | L-ascorbic acid | Diethylamino-(C=O)— | Diethylamino-(C=O)— |
| I-21 | L-ascorbic acid | Phenyl-NH-(C=O)— | H |
| I-22 | L-ascorbic acid | Hexyl-NH-(C=O)— | Hexyl-NH-(C=O)— |
| I-23 | L-ascorbic acid | t-Butyl-(C=O)— | Ethyl-(C=O)— |
| I-24 | L-ascorbic acid | Ethyl-(C=O)— | Ethyl-(C=O)— |
| I-25 | L-ascorbic acid | Ethyl-O-(C=O)— | H |
| I-26 | L-ascorbic acid | Phenyl-O-(C=O)— | H |
| I-27 | L-ascorbic acid | 4-HO-Phenyl-(C=O)— | H |
| I-28 | L-ascorbic acid | 2-norbornylmethyl-(C=O)— | H |
| I-29 | L-ascorbic acid | 3,4-$(HO)_2$-Phenyl-(C=O)— | H |
| I-30 | L-ascorbic acid | i-Propyl-(C=O)— | i-Propyl-(C=O)— |
| I-31 | L-ascorbic acid | Ethyl-(C=O)— | Ethyl-(C=O)— |

Thermographic materials of this invention may include the same or different types of reducing agents as described above. For example, reducing agents useful in thermographic materials also include aromatic di- and tri-hydroxy compounds (such as hydroquinones, gallic acid and gallic acid derivatives, catechols, and pyrogallols), aminophenols, p-phenylenediamines, alkoxynaphthols, pyrazolidin-3-one type reducing agents, pyrazolin-5-ones, polyhydroxy spiro-bis-indanes, indan-1,3-dione derivatives, hydroxytetrone acids, hydroxytetronimides, hydroxylamine derivatives, hydrazine derivatives, hindered phenols, amidoximes, azines, reductones (for example, ascorbic acid and ascorbic acid derivatives), and other materials readily apparent to one skilled in the art.

Other useful reducing agents are aromatic di- and tri-hydroxy compounds having at least two hydroxy groups in ortho- or para-relationship on the same aromatic nucleus such as hydroquinone and substituted hydroquinones, catechols, pyrogallol, gallic acid and gallic acid esters, and tannic acid.

Particularly useful catechol-type reducing agents have no more than two hydroxy groups in an ortho-relationship and include catechol, 3-(3,4-dihydroxy-phenyl)-propionic acid, 2,3-dihydroxy-benzoic acid, 2,3-dihydroxy-benzoic acid esters and amides, 3,4-dihydroxy-benzoic acid, and 3,4-dihydroxy-benzoic acid esters and amides. Other catechol-type reducing agents are benzene compounds in which the benzene nucleus is substituted by no more than two hydroxy groups in the 2- and 3-positions and have in the 1-position of the nucleus a substituent linked to the nucleus by means of a carbonyl group. Such compounds are described in U.S. Pat. No. 5,582,953 (Uyttendaele et al.) that is incorporated herein by reference.

Still another class of reducing agents are polyhydroxy spiro-bis-indane compounds that are described in U.S. Pat. No. 3,440,049 (Moede) and as reducing agents in U.S. Pat. No. 5,817,598 (Defieuw et al.), both incorporated herein by reference.

If desired, co-developers and contrast enhancing agents may be used in combination with the reducing agents described herein. Various contrast enhancing agents may be used in some photothermographic materials with specific developers and/or co-developers. Examples of useful contrast enhancing agents include, but are not limited to, hydroxyiamines, alkanolamines and ammonium phthalamate compounds as described in U.S. Pat. No. 5,545,505 (Simpson), hydroxamic acid compounds as described in U.S. Pat. No. 5,545,507 (Simpson et al.), N-acylhydrazine compounds as described in U.S. Pat. No. 5,558,983 (Simpson et al.), and hydrogen atom donor compounds as described in U.S. Pat. No. 5,637,449 (Harring et al.). All of the patents above are incorporated herein by reference.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Co-developers may be present generally in an amount of from about 0.001% to about 1.5% (dry weight) of the emulsion layer coating.

Other Addenda

The thermally developable materials of this invention can also include one or more compounds that are known in the art as "toners" that are compounds that when added to the imaging layer shift the color of the developed silver image from yellowish-orange to brown-black or blue-black, and/or act as development accelerators to speed up thermal development.

Compounds that either act as toners or react with a reducing agent to provide toners can be present in an amount of about 0.01% by weight to about 10% (preferably from about 0.1% to about 10% by weight) based on the total dry weight of the layer in which they are included. The amount can also be defined as being within the range of from about $1\times10^{-5}$ to about 1.0 mol per mole of non-photosensitive source of reducible silver in the material. The toner compounds may be incorporated in one or more of the thermally developable layers as well as in adjacent layers such as a protective overcoat layer or underlying "carrier" layer. Toners can be located on both sides of the support if thermally developable layers are present on both sides of the support.

Compounds useful as toners are described, for example, in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Particularly useful toners are substituted and unsubstituted mercaptotriazoles as described in U.S. Pat. No. 3,832,186 (Masuda et al.), U.S. Pat. No. 6,165,704 (Miyake et al.), U.S. Pat. No. 5,149,620 (Simpson et al.), U.S. Pat. No.

6,713,240 (Lynch et al.), and copending and commonly assigned U.S. Published Application 2004-0013984 (Lynch et al.), the heterocyclic disulfide compounds described in copending and commonly assigned U.S. Ser. No. 10/384,244 (filed Mar. 7, 2003 by Lynch and Ulrich), and the triazine-thione compounds described in U.S. Pat. No. 6,703,191 (Lynch et al.). All of the above are incorporated herein by reference.

Phthalazine and phthalazine derivatives [such as those described in U.S. Pat. No. 6,146,822 (Asanuma et al.) incorporated herein by reference] are useful toners, as well as phthalazinone, and phthalazinone derivatives including compounds that are prepared by the reaction of an acrylic acid and a phthalazine as described in U.S. Pat. No. 6,605,418 (Ramsden et al.) incorporated herein by reference.

The photothermographic materials of this invention can also contain other additives such as shelf-life stabilizers, antifoggants, contrast enhancing agents, development accelerators, acutance dyes, post-processing stabilizers or stabilizer precursors, thermal solvents (also known as melt formers), humectants, and other image-modifying agents as would be readily apparent to one skilled in the art.

To further control the properties of photothermographic materials, (for example, contrast, Dmin, speed, or fog), it may be preferable to add one or more heteroaromatic mercapto compounds or heteroaromatic disulfide compounds of the formulae Ar—S—$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Useful heteroaromatic mercapto compounds are described as supersensitizers in EP 0 559 228 B1 (Philip Jr. et al.).

The photothermographic materials of the present invention can be further protected against the production of fog and can be stabilized against loss of sensitivity during storage. Suitable antifoggants and stabilizers that can be used alone or in combination include thiazolium salts as described in U.S. Pat. No. 2,131,038 (Brooker et al.) and U.S. Pat. No. 2,694,716 (Allen), azaindenes as described in U.S. Pat. No. 2,886,437 (Piper), triazaindolizines as described in U.S. Pat. No. 2,444,605 (Heimbach), urazoles as described in U.S. Pat. No. 3,287,135 (Anderson), sulfocatechols as described in U.S. Pat. No. 3,235,652 (Kennard), oximes as described in GB 623,448 (Carrol et al.), polyvalent metal salts as described in U.S. Pat. No. 2,839,405 (Jones), thiuronium salts as described in U.S. Pat. No. 3,220,839 (Herz), compounds having —$SO_2CBr_3$ groups as described in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

The photothermographic materials may also include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds. Particularly useful antifoggants of this type are polyhalo antifoggants, such as those having a —$SO_2C(X')_3$ group wherein X' represents the same or different halogen atoms.

Another class of useful antifoggants includes those compounds described in U.S. Pat. No. 6,514,678 (Burgmaier et al.), incorporated herein by reference.

Advantageously, the photothermographic materials of this invention also include one or more thermal solvents (also called "heat solvents," "thermosolvents," "melt formers," "melt modifiers," "eutectic formers," "development modifiers," "waxes," or "plasticizers").

By the term "thermal solvent" in this invention is meant an organic material that becomes a plasticizer or liquid solvent for at least one of the imaging layers upon heating at a temperature above 60° C. Useful for that purpose are polyethylene glycols having a mean molecular weight in the range of 1,500 to 20,000, urea, methyl sulfonamide, ethylene carbonate, and compounds described as thermal solvents in *Research Disclosure,* December 1976, item 15027, pp. 26–28. Other representative examples of such compounds include niacinamide, hydantoin, 5,5-dimethylhydantoin, salicylanilide, succinimide, phthalimide, N-potassium-phthalimide, N-hydroxyphthalimide, N-hydroxy-1,8-naphthalimide, phthalazine, 1-(2H)-phthalazinone, 2-acetylphthalazinone, benzanilide, 1,3-dimethylurea, 1,3-diethylurea, 1,3-diallylurea, meso-erythritol, D-sorbitol, tetrahydro-2-pyrimidone, glycouril, 2-imidazolidone, 2-imidazolidone-4-carboxylic acid, and benzenesulfonamide. Combinations of these compounds can also be used including, for example, a combination of succinimide and 1,3-dimethylurea.

It may be advantageous to include a base-release agent or base precursor in the photothermographic materials. Representative base-release agents or base precursors include guanidinium compounds, such as guanidinium trichloroacetate, and other compounds that are known to release a base but do not adversely affect photographic silver halide materials, such as phenylsulfonyl acetates as described in U.S. Pat. No. 4,123,274 (Knight et al.).

Phosphors

In some embodiments, it is also effective to incorporate X-radiation-sensitive phosphors in the photothermographic materials of this invention as described in U.S. Pat. No. 6,573,033 (Simpson et al.) and U.S. Pat. No. 6,440,649 (Simpson et al.), both of which are incorporated herein by reference.

Any conventional or useful storage or prompt-emitting phosphor can be used, singly or in mixtures, in the practice of this invention.

The one or more phosphors used in the practice of this invention are present in the photothermographic materials in an amount of at least 0.1 mole per mole, and preferably from about 0.5 to about 20 mole per mole, of total silver in the photothermographic material.

Binders

The photosensitive silver halide (if present), the rod-like organic silver salts described above, the reducing agent, antifoggant(s), toner(s), and any other additives used in the present invention are added to and coated in one or more binders using a suitable aqueous solvent. Thus, aqueous-based formulations are used to prepare the thermographic and photothermographic materials of this invention. Mixtures of different types of hydrophilic and/or hydrophobic binders can also be used. Preferably, hydrophilic polymer binders and water-dispersible polymeric latexes are used to provide aqueous-based materials in this invention.

Examples of useful hydrophilic polymer binders include, but are not limited to, proteins and protein derivatives, gelatin and gelatin derivatives (hardened or unhardened), cellulosic materials, acrylamide/methacrylamide polymers, acrylic/methacrylic polymers, polyvinyl pyrrolidones, polyvinyl alcohols, poly(vinyl lactams), polymers of sulfoalkyl acrylate or methacrylates, hydrolyzed polyvinyl acetates, polyamides, polysaccharides, and other naturally occurring or synthetic vehicles commonly known for use in aqueous-based photographic emulsions (see for example *Research Disclosure,* item 38957, noted above).

Particularly useful hydrophilic polymer binders are gelatin, gelatin derivatives, polyvinyl alcohols, and cellulosic materials. Gelatin and its derivatives are most preferred, and comprise at least 75 weight % of total binders when a mixture of binders is used.

Aqueous dispersions of water-dispersible polymeric latexes may also be used, alone or with hydrophilic or hydrophobic binders described herein. Such dispersions are described in, for example, U.S. Pat. No. 4,504,575 (Lee), U.S. Pat. No. 6,083,680 (Ito et al), U.S. Pat. No. 6,100,022 (Inoue et al.), U.S. Pat. No. 6,132,949 (Fujita et al.), U.S. Pat. No. 6,132,950 (Ishigaki et al.), U.S. Pat. No. 6,140,038 (Ishizuka et al.), U.S. Pat. No. 6,150,084 (Ito et al.), U.S. Pat. No. 6,312,885 (Fujita et al.), U.S. Pat. No. 6,423,487 (Naoi), all of which are incorporated herein by reference.

Minor amounts (less than 50 weight % based on total binder weight) of hydrophobic binders (not in latex form) may also be used. Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. The polyvinyl acetals (such as polyvinyl butyral and polyvinyl formal), cellulose ester polymers, and vinyl copolymers (such as polyvinyl acetate and polyvinyl chloride) are preferred. Particularly suitable binders are polyvinyl butyral resins that are available under the name BUTVAR® from Solutia, Inc.(St. Louis, Mo.) and PIOLOFORM® from Wacker Chemical Company (Adrian, Mich.) and cellulose ester polymers.

Hardeners for various binders may be present if desired. Useful hardeners are well known and include diisocyanates as described for example, in EP 0 600 586B1 (Philip, Jr. et al.) and vinyl sulfone compounds as described in U.S. Pat. No. 6,143,487 (Philip, Jr. et al.), and EP 0 640 589A1 (Gathmann et al.), aldehydes and various other hardeners as described in U.S. Pat. No. 6,190,822 (Dickerson et al.).

Where the proportions and activities of the photothermographic materials require a particular developing time and temperature, the binder(s) should be able to withstand those conditions. Generally, it is preferred that the binder does not decompose or lose its structural integrity at 120° C. for 60 seconds. It is more preferred that it does not decompose or lose its structural integrity at 177° C. for 60 seconds.

The binder(s) is used in an amount sufficient to carry the components dispersed therein. Preferably, a binder is used at a level of about 10% by weight to about 90% by weight, and more preferably at a level of about 20% by weight to about 70% by weight, based on the total dry weight of the layer in which it is included. The amount of binders on opposing sides of the support in double-sided materials may be the same or different.

Support Materials

The thermally developable materials of this invention comprise a polymeric support that is preferably a flexible, transparent film that has any desired thickness and is composed of one or more polymeric materials. They are required to exhibit dimensional stability during thermal development and to have suitable adhesive properties with overlying layers. Useful polymeric materials for making such supports include, but are not limited to, polyesters, cellulose acetate and other cellulose esters, polyvinyl acetal, polyolefins, polycarbonates, and polystyrenes. Preferred supports are composed of polymers having good heat stability, such as polyesters and polycarbonates. Polyethylene terephthalate film is a particularly preferred support. Support materials may also be treated or annealed to reduce shrinkage and promote dimensional stability.

It is also useful to use supports comprising dichroic mirror layers as described in U.S. Pat. No. 5,795,708 (Boutet), incorporated herein by reference.

Also useful are transparent, multilayer, polymeric supports comprising numerous alternating layers of at least two different polymeric materials that preferably reflect at least 50% of actinic radiation in the range of wavelengths to which the photothermographic material is sensitive. Such polymeric supports are described in U.S. Pat. No. 6,630,283 (Simpson et al.) that is incorporated herein by reference.

Support materials can contain various colorants, pigments, antihalation or acutance dyes if desired. For example, blue-tinted supports are particularly useful for providing images useful for medical diagnosis. Support materials may be treated using conventional procedures (such as corona discharge) to improve adhesion of overlying layers, or subbing or other adhesion-promoting layers can be used.

Photothermographic Formulations

The emulsion components are prepared in a formulation containing a hydrophilic polymer binder (such as gelatin, a gelatin-derivative, or a cellulosic material) or a water-dispersible polymer in latex form in water or water-organic solvent mixtures to provide aqueous-based coating formulations.

The materials of the invention can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic or organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (Kub).

U.S. Pat. No. 6,436,616 (Geisler et al.), incorporated herein by reference, describes various means of modifying photothermographic materials to reduce what is known as the "woodgrain" effect, or uneven optical density.

The materials of this invention can include one or more antistatic agents in any of the layers on either or both sides of the support. Conductive components include soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), electroconductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles described in U.S. Pat. No. 6,689,546 (LaBelle et al.). All of the above patents and patent applications are incorporated herein by reference.

Still other conductive compositions include one or more fluoro-chemicals each of which is a reaction product of $R_f$—$CH_2CH_2$—$SO_3H$ with an amine wherein $R_f$ comprises 4 or more fully fluorinated carbon atoms as described in U.S. Pat. No. 6,699,648 (Sakizadeh et al.) that is incorporated herein by reference.

Additional conductive compositions include one or more fluoro-chemicals described in more detail in copending and commonly assigned U.S. Ser. No. 10/265,058 (filed Oct. 4, 2002 by Sakizadeh, LaBelle, and Bhave) that is incorporated herein by reference.

For double-sided thermally developable materials, each side of the support can include one or more of the same or different imaging layers, interlayers, and protective topcoat layers. In such materials preferably a topcoat is present as the outermost layer on both sides of the support. The thermally developable layers on opposite sides can have the same or different construction and can be overcoated with the same or different protective layers. The organic silver salts can be the same or different on opposite sides of the support.

Photothermographic materials having thermally developable layers disposed on both sides of the support may suffer from "crossover" when radiation used to image one side of the photothermographic material is transmitted through the support and images the photothermographic layer(s) on the opposite side of the support. Various methods are available for reducing crossover including the use of "anti-crossover" dyes.

Layers to promote adhesion of one layer to another are also known, as described in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), U.S. Pat. No. 6,667,148 (Rao et al.), and U.S. Ser. No. 10/351,814 (filed Jan. 27, 2003 by Hunt), all incorporated herein by reference.

The formulations described herein (including the thermally developable formulations) can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

Simultaneously with or subsequently to application of an emulsion formulation to the support, a protective overcoat formulation can be applied over the emulsion formulation.

Preferably, two or more layer formulations are applied simultaneously to a film support using slide coating techniques, the first layer being coated on top of the second layer while the second layer is still wet.

In other embodiments, a "carrier" layer formulation comprising a single-phase mixture of the two or more polymers may be applied directly onto the support and thereby located underneath the emulsion layer(s) as described in U.S. Pat. No. 6,355,405 (Ludemann et al.), incorporated herein by reference. The carrier layer formulation can be applied simultaneously with application of the emulsion layer formulation.

Mottle and other surface anomalies can be reduced in the materials by incorporation of a fluorinated polymer as described in U.S. Pat. No. 5,532,121 (Yonkoski et al.) or by using particular drying techniques as described in U.S. Pat. No. 5,621,983 (Ludemann et al.).

While the first and second layers can be coated on one side of the film support, manufacturing methods can also include forming on the opposing or backside of the polymeric support, one or more additional layers, including a conductive layer, antihalation layer, or a layer containing a matting agent (such as silica), or a combination of such layers. Alternatively, one backside layer can perform all of the desired functions.

To promote image sharpness, photothermographic materials of the present invention can contain one or more layers containing acutance and/or antihalation dyes that are chosen to have absorption close to the exposure wavelength and are designed to absorb scattered light. One or more antihalation compositions may be incorporated into one or more antihalation backing layers, antihalation underlayers, or as antihalation overcoats.

Dyes useful as antihalation and acutance dyes include squaraine dyes described in U.S. Pat. No. 5,380,635 (Gomez et al.), U.S. Pat. No. 6,063,560 (Suzuki et al.), and EP 1 083 459A1 (Kimura), indolenine dyes described in EP 0 342 810A1 (Leichter), and cyanine dyes described in U.S. Published Application 2003-0162134 (Hunt et al.), all incorporated herein by reference.

It may also be useful to employ compositions including acutance or antihalation dyes that will decolorize or bleach with heat during processing, as described in U.S. Pat. No. 5,135,842 (Kitchin et al.), U.S. Pat. No. 5,266,452 (Kitchin et al.), U.S. Pat. No. 5,314,795 (Helland et al.), U.S. Pat. No. 6,306,566, (Sakurada et al.), JP Kokai 2001-142175 (Hanyu et al.), and JP Kokai 2001-183770 (Hanye et al.). Useful bleaching compositions are also described in JP Kokai 11-302550 (Fujiwara), JP Kokai 2001-109101 (Adachi), JP Kokai 2001-51371 (Yabuki et al.), and JP Kokai 2000-029168 (Noro). All of the noted publications are incorporated herein by reference.

Other useful heat-bleachable backside antihalation compositions can include an infrared radiation absorbing compound such as an oxonol dye or other compounds used in combination with a hexaarylbiimidazole (also known as a "HABI"), or mixtures thereof. HABI compounds are described in U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in U.S. Pat. No. 6,455,210 (Irving et al.), U.S. Pat. No. 6,514,677 (Ramsden et al.), and U.S. Pat. No. 6,558,880 (Goswami et al.), all incorporated herein by reference.

Under practical conditions of use, these compositions are heated to provide bleaching at a temperature of at least 90° C. for at least 0.5 seconds (preferably, at a temperature of from about 100° C. to about 200° C. for from about 5 to about 20 seconds).

In some embodiments, the thermally developable materials of this invention include a surface protective layer over one or more imaging layers on one or both sides of the support. In other embodiments, the materials include a surface protective layer on the same side of the support as the one or more emulsion layers and a layer on the backside that includes an antihalation and/or conductive antistatic composition. A separate backside surface protective layer can also be included in these embodiments.

Imaging/Development

The photothermographic materials of the present invention can be imaged in any suitable manner consistent with the type of material, using any suitable imaging source (typically some type of radiation or electronic signal). In some embodiments, the materials are sensitive to radiation in the range of from about at least 100 nm to about 1400 nm, and preferably from about 100 nm to about 700 nm, using appropriate spectral sensitizing dyes.

Imaging can be achieved by exposing the photothermographic materials of this invention to a suitable source of radiation to which they are sensitive, including ultraviolet radiation, visible light, near infrared radiation, and infrared radiation to provide a latent image. Suitable exposure means are well known and include incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art such as described in *Research Disclosure,* item 38957 (noted above).

In some embodiments, the photothermographic materials can be imaged using an X-radiation imaging source and one or more prompt-emitting or storage X-ray sensitive phosphor screens adjacent to the photothermographic material. The phosphors emit suitable radiation to expose the photothermographic material.

In other embodiments, the photothermographic materials can be imaged directly using an X-radiation imaging source to provide a latent image.

Thermal development conditions will vary, depending on the construction used but will typically involve heating the photothermographic material at a suitably elevated temperature, for example, at from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means. A preferred heat development procedure for photothermographic materials includes heating at from 130° C. to about 165° C. for from about 3 to about 25 seconds.

Imaging of the thermographic materials of this invention is carried out using a suitable imaging source of thermal energy such as a thermal print head.

Use as a Photomask

In some embodiments, the photothermographic and thermographic materials of the present invention are sufficiently transmissive in the range of from about 350 to about 450 nm in non-imaged areas to allow their use in a method where there is a subsequent exposure of an ultraviolet or short wavelength visible radiation sensitive imageable medium. The heat-developed materials absorb ultraviolet or short wavelength visible radiation in the areas where there is a visible image and transmit ultraviolet or short wavelength visible radiation where there is no visible image. The materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate.

Imaging Assemblies

In some embodiments, the photothermographic materials of this invention are used in association with one or more phosphor intensifying screens and/or metal screens in what is known as "imaging assemblies." Double-sided X-radiation sensitive photothermographic materials are preferably used in combination with two adjacent intensifying screens, one screen in the "front" and one screen in the "back" of the material. The front and back screens can be appropriately chosen depending upon the type of emissions desired, the desired photicity, emulsion speeds, and percent crossover. The imaging assemblies can be prepared by arranging the photothermographic material and one or more phosphor intensifying screens in a suitable holder (often known as a cassette), and appropriately packaging them for transport and imaging uses. There are a wide variety of phosphors known in the art that can be formulated into phosphor intensifying screens as described in hundreds of publications. U.S. Pat. No. 6,573,033 (noted above) describes phosphors that can be used in this manner.

The following examples are provided to illustrate the practice of the present invention and the invention is not meant to be limited thereby.

Materials and Methods for the Examples:

All materials used in the following examples can be prepared using known synthetic procedures or are readily available from standard commercial sources, such as Aldrich Chemical Co. (Milwaukee, Wis.) unless otherwise specified. All percentages are by weight unless otherwise indicated.

BZT is benzotriazole. AgBZT is silver benzotriazole.

Densitometry measurements were carried out on an X-Rite® Model 301 densitometer that is available from X-Rite Inc. (Grandville, Mich.).

Compound A-1 is described in U.S. Pat. No. 6,605,418 (noted above) and is believed to have the following structure.

(A-1)

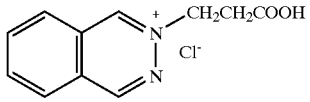

Compound SS-1a is described in U.S. Pat. No. 6,296,998 (Eikenberry et al.) and is believed to have the following structure.

(SS-1a)

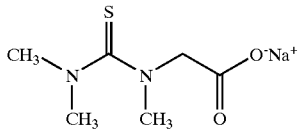

Blue sensitizing dye SSD-1 is believed to have the following structure.

(SSD-1)

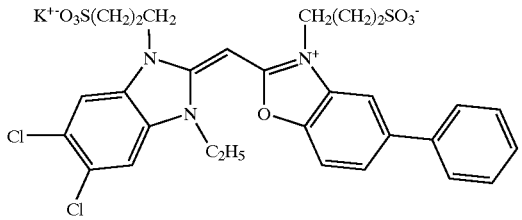

Compound T-1 is the sodium salt of 2,4-dihydro-4-(phenylmethyl)-3H-1,2,4-triazole-3-thione and is believed to have the following structure (it may also exist as the sodium salt of the thione tautomer).

(T-1)

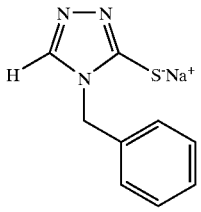

Bisvinyl sulfonyl methane (VS-1) is 1,1'(methylenebis(sulfonyl))bis-ethene and is believed to have the following structure.

(VS-1)

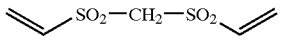

Preparation of Tabular Grain Silver Halide Emulsion:

A reaction vessel equipped with a stirrer was charged with 6 liters of water containing 4.21 g of lime-processed bone gelatin, 4.63 g of sodium bromide, 37.65 mg of potassium iodide, an antifoaming agent, and 1.25 ml of 0.1 molar sulfuric acid. The solution was then held at 39° C. for 5 minutes. Simultaneous additions were then made of 5.96 ml of 2.5378 molar silver nitrate and 5.96 ml of 2.5 molar sodium bromide over 4 seconds. Following nucleation, 0.745 ml of a 4.69% solution of sodium hypochlorite was added. The temperature was increased to 54° C. over 9 minutes. After a 5-minute hold, 100 g of oxidized methionine lime-processed bone gelatin in 1.412 liters of water containing additional antifoaming agent at 54° C. were then added to the reactor. The reactor temperature was held for 7 minutes, after which 106 ml of 5 molar sodium chloride containing 2.103 g of sodium thiocyanate were added. The reaction was continued for 1 minute.

During the next 38 minutes, the first growth stage took place wherein solutions of 0.6 molar silver nitrate, 0.6 molar sodium bromide, and a 0.29 molar suspension of silver iodide (Lippmann) were added to maintain a nominal uniform iodide level of 4.2 mole %. The flow rates during this growth segment were increased from 9 to 42 ml/min (silver nitrate) and from 0.8 to 3.7 ml/min (silver iodide). The flow rates of the sodium bromide were allowed to fluctuate as needed to maintain a constant pBr. At the end of this growth segment, 78.8 ml of 3.0 molar sodium bromide were added and held for 3.6 minutes.

During the next 75 minutes, the second growth stage took place wherein solutions of 3.5 molar silver nitrate and 4.0 molar sodium bromide and a 0.29 molar suspension of silver iodide (Lippmann) were added to maintain a nominal iodide level of 4.2 mole %. The flow rates during this segment were increased from 8.6 to 30 ml/min (silver nitrate) and from 4.5 to 15.6 ml/min (silver iodide). The flow rates of the sodium bromide were allowed to fluctuate as needed to maintain a constant pBr.

During the next 15.8 minutes, the third growth stage took place wherein solutions of 3.5 molar silver nitrate, 4.0 molar sodium bromide, and a 0.29 molar suspension of silver iodide (Lippmann) were added to maintain a nominal iodide level of 4.2 mole %. The flow rates during this segment were 35 ml/min (silver nitrate) and 15.6 ml/min (silver iodide). The temperature was decreased to 47.8° C. during this addition segment.

During the next 32.9 minutes, the fourth growth stage took place wherein solutions of 3.5 molar silver nitrate and 4.0 molar sodium bromide and a 0.29 molar suspension of silver iodide (Lippmann) were added to maintain a nominal iodide level of 4.2 mole %. The flow rates during this segment were held constant at 35 ml/min (silver nitrate) and 15.6 ml/min (silver iodide). The temperature was decreased to 35° C. during this segment.

A total of 12 moles of silver iodobromide (4.2% bulk iodide) were formed. The resulting emulsion was coagulated using 430.7 g of phthalated lime-processed bone gelatin and washed with de-ionized water. Lime-processed bone gelatin (269.3 g) was added along with a biocide and pH and pBr were adjusted to 6 and 2.5 respectively.

The resulting emulsion was examined using Scanning Electron Microscopy. Tabular grains accounted for greater than 99% of the total projected area. The mean ECD of the grains was 2.369 $\mu$m. The mean tabular thickness was 0.062 $\mu$m.

The silver halide grains in this emulsion were spectrally sensitized with 1.0 mmol of blue sensitizing dye SSD-1 per mole of silver halide. Chemical sensitization was carried out with sulfur sensitizing compound SS-1a at 60° C. for 10 minutes.

Example 1

Preparation of AgBZT Dispersion

Aqueous gelatin dispersions of silver benzotriazole (AgBZT) A through F (TABLE II below) were prepared as follows:

A stirred reaction vessel was charged with 900 g of lime-processed gelatin and 6000 g of deionized water. Solution A containing 216 g/kg of benzotriazole, 710 g/kg of deionized water, and 74 g/kg of sodium hydroxide was prepared. The mixture in the reaction vessel was adjusted to a pH of 9.0 with 2.5N sodium hydroxide solution. The pAg was adjusted by addition of varying amount of Solution A (TABLE II). The temperature of the reaction vessel was maintained at approximately 50° C.

Solution B containing 362 g/kg of silver nitrate and 638 g/kg of deionized water was also prepared. Solutions A and B were then added to the reaction vessel by controlled double-jet addition at a constant silver nitrate flow rate of 25 ml/min for 20 minutes while maintaining constant pAg and pH in the reaction vessel. The flow rate of Solution B was then accelerated over 41 minutes to about 40 ml/min, while maintaining constant pAg and pH throughout the process. The flow rate of Solution B was further accelerated over 30.5 minutes to about 80 ml/min during the last stage of the process while maintaining constant pAg and pH in the reaction vessel.

The resulting silver benzotriazole dispersions were washed by conventional ultrafiltration process as described in *Research Disclosure*, Vol. 131, March 1975, Item 13122. The pH of the dispersions was adjusted to 6.0 using 2.0N sulfuric acid. Upon cooling, the dispersions solidified.

Dispersions B, C, D, E, and F were prepared using conditions of the present invention while Dispersion A was not.

TABLE II

| Dispersion | Amount of Solution A Added (g) | Measured vAg (mV) | pAg |
|---|---|---|---|
| A | 310 | −80 | 10.91 |
| B | 156 | −50 | 10.35 |
| C | 38.5 | 0 | 9.50 |
| D | 8.0 | 50 | 8.71 |
| E | 0.7 | 100 | 7.93 |
| F | 0.0 | 170 | 6.83 |

Measurement of Grain Size and Haze of Silver Benzotriazole Particles:

Grain size and size distribution of the silver benzotriazole particles in the dispersions were measured using a transmission electron microscope. Particle length, diameter, and aspect ratio are reported below in TABLE III.

The haze of coated formulations of silver benzotriazole particles was measured as follows:

A mixture of each silver benzotriazole dispersion (10 mmol), water (14 g), and lime-processed gelatin (1.25 g) was held at 40° C. for 30 minutes with stirring. The resulting silver benzotriazole emulsions were each coated on a 7-mil poly(ethylene terephthalate) film support to give a silver coat weight of approximately 2.0 g/m$^2$. The coatings were dried at 120° F. (49° C.) for 6 minutes.

Haze (%) was measured in accord with ASTM D 1003 by conventional means using a Haze-gard Plus Hazemeter that is available from BYK-Gardner (Columbia, Md.). The haze value of the support (~2.50%) was subtracted from the measurement and the % haze due to the silver benzotriazole coatings only is reported.

Figure 2:
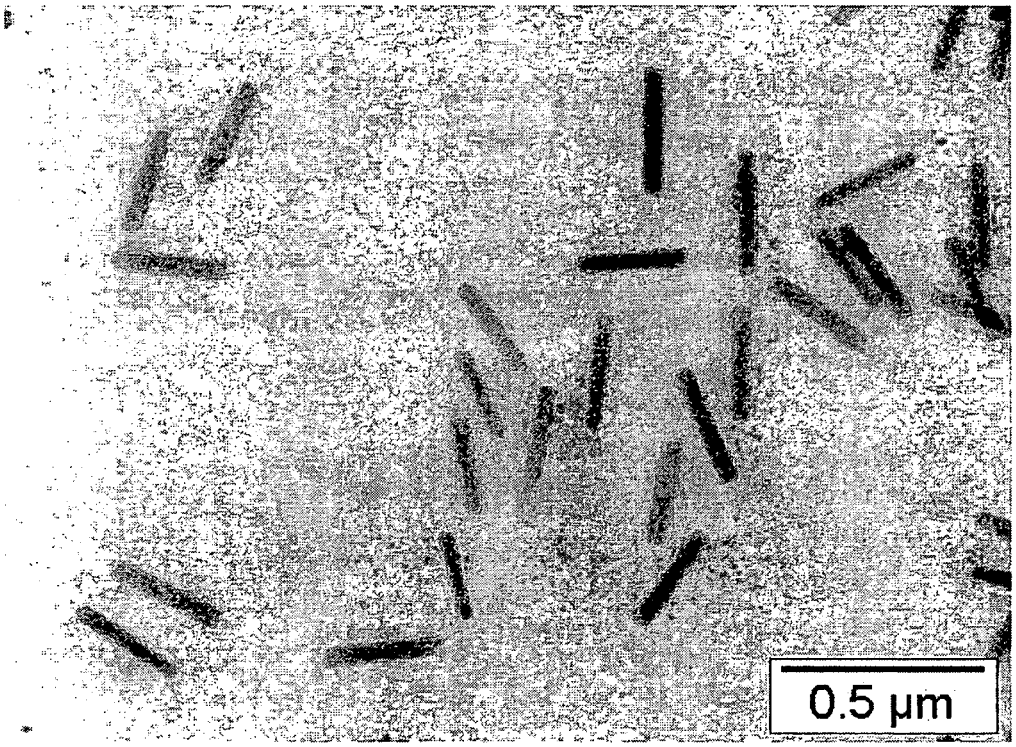
FIG. 2 is a black-and-white photograph of highly magnified silver benzotriazole crystals prepared as Dispersion D of the present invention in Example 1.

The results of particle size and haze measurements, shown below in TABLE III, demonstrate that when the vAg of silver benzotriazole preparation is controlled to be more negative than −50 mV, large silver benzotriazole particles having an undesirably low aspect ratio and causing high haze were formed (Dispersion A). However, when vAg was controlled to a value equal to or more positive than −50 mV, as in Dispersions B through F, AgBZT particle size was decreased and/or aspect ratio was increased and the haze level was reduced. FIGS. 1 and 2 provide photographic images of Dispersions A and D described herein and clearly show the different sizes and morphology of the AgBZT particles. Dispersion D was prepared using a more preferred embodiment of the present invention wherein the vAg was controlled to a value of +50 mV. It is evident that its silver salt particles are more uniformly rod-like in shape than those prepared in Dispersion A (comparative).

TABLE III

| AgBZT Dispersion | vAg | Grain Size | | | | |
|---|---|---|---|---|---|---|
| | | Length | Diameter | Width Index (Diameter) | Aspect Ratio | % Haze |
| A (comparative) | −80 mV | 0.39 | 0.094 | 1.28 | 4.21 | 19.40 |
| B (invention) | −50 mV | 0.32 | 0.078 | 1.23 | 4.15 | 7.39 |
| C (invention) | 0 mV | 0.25 | 0.062 | 1.13 | 4.03 | 3.80 |
| D (invention) | 50 mV | 0.28 | 0.054 | 1.14 | 5.15 | 2.41 |
| E (invention) | 100 mV | 0.35 | 0.054 | 1.19 | 6.59 | 2.90 |
| F (invention) | 150 mV | 0.32 | 0.055 | 1.17 | 5.85 | 2.73 |

Example 2

Preparation of Photothermographic Materials

Photothermographic materials of this invention and Comparative materials were prepared and evaluated as follows:

Solution A: Each dispersion of silver benzotriazole and gelatin (35% gelatin/65% water) prepared above was placed in a beaker and heated to 50° C. for 15 minutes to melt the dispersion. A 5% aqueous solution of 3-methylbenzothiazolium iodide was added. Each dispersion was mixed for 15 minutes and cooled to 40° C. The sodium salt of benzotriazole was added and the dispersions were stirred again for 15 minutes followed by addition of Compound T-1. Mixing for another 15 minutes was followed by addition of 2.5 N sulfuric acid to adjust the dispersion pH to 5.5. Zonyl FSN surfactant was then added.

Solution B: A portion of the tabular-grain silver halide emulsion prepared as described above was placed in a beaker and melted by heating at 40° C.

Solution C: The dry materials listed in TABLE IV below were added to water and heating to 40° C.

Photothermographic materials were prepared by coating each of silver benzotriazole Dispersions A through F, the thin tabular grain silver halide emulsion, and other ingredients shown in TABLE IV. The imaging formulations were coated as a single layer on a 7-mil (178 $\mu$m) transparent, blue-tinted poly(ethylene terephthalate) film support, and dried at 122° F. (50° C.) for 7 minutes.

TABLE IV

| Solution | Component | Dry Coating Weight (g/m$^2$) |
|---|---|---|
| A | Silver benzotriazole (Samples A–F) | 1.60 |
| A | Lime processed gelatin | 3.18 |
| A | Sodium benzotriazole | 0.11 |
| A | Compound T-1 | 0.078 |
| B | Silver (from silver halide emulsion) | 0.32 |
| C | Succinimide | 0.14 |

TABLE IV-continued

| Solution | Component | Dry Coating Weight (g/m$^2$) |
|---|---|---|
| C | 1,3-Dimethylurea | 0.49 |
| C | Compound A-1 | 0.07 |
| C | Compound VS-1 | 0.07 |
| C | Pentaerythritol | 0.63 |
| C | Ascorbic acid 6-pivalate | 3.10 |

The resulting photothermographic films were imagewise exposed for $10^{-2}$ seconds using an EG&G flash sensitometer equipped with a P-16 filter and a 0.7 neutral density filter. Following exposure, the films were thermally processed using a heated flatbed processor for 18 seconds at 150° C.

Densitometry measurements were made on a custom built computerized scanning-densitometer that meets ISO Standards 5–2 and 5–3 and takes an optical density reading every 0.33 mm. The results are believed to be comparable to measurements from commercially available densitometers.

Density of the wedges was measured using a filter appropriate to the sensitivity of the photothermographic material to obtain graphs of density versus log exposure (that is, D log E curves). Dmin is the density of the non-exposed areas after development and it is the average of the eight lowest density values.

Figure 3:
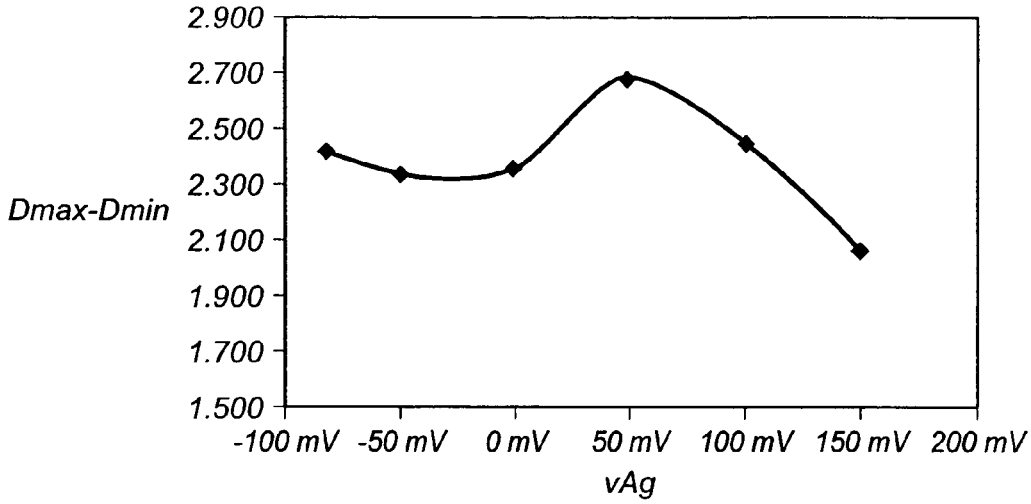
FIG. 3 is a graphical plot of imaging discrimination, Dmax–Dmin vs. vAg.
Figure 4:
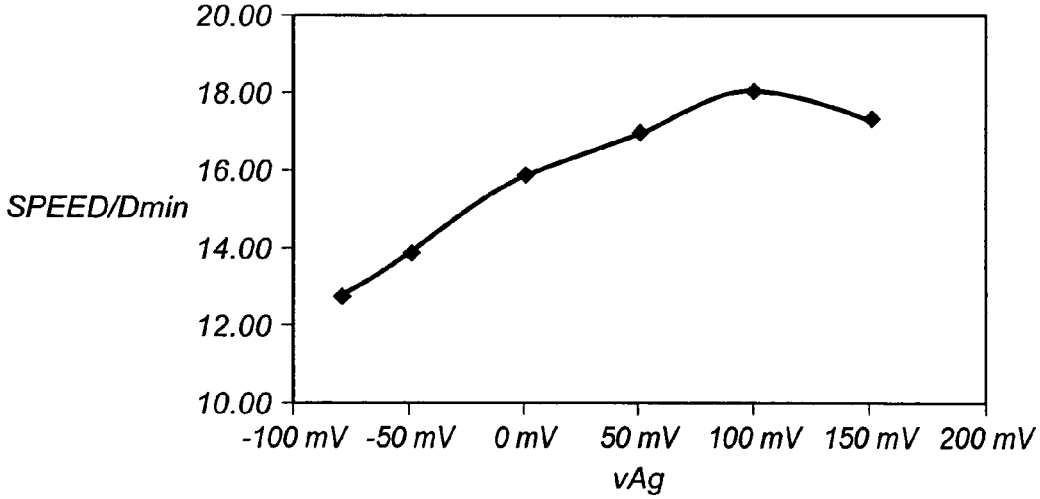
FIG. 4 is a graphical plot of the ratio of photographic speed to Dmin (speed/Dmin) vs. vAg.

The sensitometry results, shown below in TABLE V, demonstrate that the highest photothermographic sensitivity, imaging discrimination ($D_{max}$-$D_{min}$), as well as relative speed (Speed-2/Dmin) were achieved when the silver benzotriazole particles were prepared according to the present invention, that is while vAg was controlled to be equal to or greater than −50 mV and more preferably when vAg was controlled within the range of from about 0 mV to about 100 mV. The sensitometric effects of the vAg during the preparation of the organic silver salt can also be seen from the graphs in FIGS. 3 and 4.

TABLE V

| AgBZT Dispersion | vAg | $D_{min}$ | $D_{max}$ | Speed-1 | Speed-2 | ($D_{max}$ − $D_{min}$) | Speed-2/$D_{min}$ |
|---|---|---|---|---|---|---|---|
| A (comparative) | −80 mV | 0.376 | 2.777 | 5.156 | 4.784 | 2.401 | 12.72 |
| B (invention) | −50 mV | 0.339 | 2.681 | 5.095 | 4.713 | 2.342 | 13.90 |
| C (invention) | 0 mV | 0.300 | 2.661 | 5.164 | 4.774 | 2.361 | 15.91 |
| D (invention) | 50 mV | 0.289 | 2.971 | 5.253 | 4.912 | 2.682 | 17.00 |
| E (invention) | 100 mV | 0.265 | 2.717 | 5.200 | 4.790 | 2.452 | 18.08 |
| F (invention) | 150 mV | 0.260 | 2.328 | 5.089 | 4.501 | 2.068 | 17.31 |

Example 3

Preparation of Photothermographic Materials Using Iridium-Doped Ultra-Thin Tabular Grain Silver Halide Emulsions An ultrathin tabular grain silver halide emulsion was prepared as described in copending and commonly assigned U.S. Ser. No. 10/826,708 (Olm et al, noted above ).

A vessel equipped with a stirrer was charged with 6 liters of water containing 4.21 g of lime-processed bone gelatin, 4.63 g of sodium bromide, 75.6 mg of potassium iodide, a known antifoamant, and 1.25 ml of 0.1 molar sulfuric acid. It was then held at 39° C. for 5 minutes. Simultaneous additions were then made of 25.187 ml of 0.6 molar silver nitrate and 19.86 ml of 0.75 molar sodium bromide over 30 seconds. Following nucleation, 50 ml of a 0.58% solution of the oxidant Oxone was added. Next, a mixture of 0.749 g of sodium thiocyanate and 30.22 g of sodium chloride dissolved in 136.4 g of water were added and the temperature was increased to 54° C. over 9 minutes. After a 5-minute hold, 100 g of oxidized methionine lime-processed bone gelatin in 1.412 liters of water containing additional antifoamant at 54° C. were then added to the vessel. During the next 38 minutes, the first growth stage took place wherein solutions of 0.6 molar silver nitrate, 0.75 molar sodium bromide, and a 0.29 molar suspension of silver iodide (Lippmann) were added to maintain a nominal uniform iodide level of 4.2 mole %. The flow rates during this growth segment were linearly increased from 9 to 42 ml/min (silver nitrate), from 11.4 to 48.17 ml/min (sodium bromide) and from 0.8 to 3.7 ml/min (silver iodide). The flow rates of the sodium bromide were unbalanced from the silver nitrate in order to increase the pBr during the segment. During the next 64 minutes, the second growth stage took place wherein solutions of 3.5 molar silver nitrate and 4.5 molar sodium bromide and a 0.29 molar suspension of silver iodide (Lippmann) were added to maintain a nominal iodide level of 4.2 mole %. The flow rates during this segment were increased from 8.6 to 38 ml/min (silver nitrate) and from 5.2 to 22.0 ml/min (silver iodide). The flow rates of the sodium bromide were allowed to fluctuate as needed to maintain a constant pBr.

During the next 38 minutes, the third growth stage took place wherein solutions of 3.5 molar silver nitrate, 4.5 molar sodium bromide, and a 0.29 molar suspension of silver iodide (Lippmann) were added to maintain a nominal iodide level of 4.2 mole %. The flow rates during this segment were 42 ml/min (silver nitrate), nominally-32 ml/min (sodium bromide)-pBr control, and 22 ml/min (silver iodide). The temperature was decreased from 54° C. to 35° C. during this segment. At a point approximately 13.5 minutes after the start of this segment, 1 ml of a 2.06 millimolar aqueous solution of $K_2$ [$IrCl_5$(5-bromo-thiazole)] was added. This corresponds to a concentration of 0.164 ppm to silver halide.

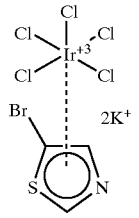

$K_2$[$IrCl_5$(5-bromo-thiazole)]

A total of 12.6 moles of silver iodobromide (4.2% bulk iodide) were formed. The resulting emulsion was washed via ultrafiltration. Lime-processed bone gelatin (269.3 g) was added along with a biocide and pH and pBr were adjusted to 6 and 2.5, respectively.

The resulting emulsion was examined by Scanning Electron Microscopy. Tabular grains accounted for greater than 99% of the total projected area. The mean ECD of the grains was 2.73 $\mu$m. The mean tabular thickness was 0.063 $\mu$m.

This emulsion was further sensitized using a sulfur sensitizer (compound SS-1 as described in U.S. Pat. No. 6,296,998 of Eikenberry et al.) at 60° C. for 10 minutes, and 2.0 mmol of blue sensitizing dye SSD-1 (shown above) per mole of silver halide was added before the chemical sensitizers.

A photothermographic material was prepared as described in Example 2 above, except that the total silver coating weight from silver halide and silver benzotriazole emulsions was 2.0 g/m$^2$ and silver benzotriazole dispersions C and D were used.

The aqueous formulations were coated, dried, and imaged as described in Example 2. The sensitometric results, shown below in TABLE VI, demonstrate that photothermographic materials incorporating both ultrathin tabular grains containing an iridium dopant and rod shaped silver benzotriazole grains have excellent $D_{min}$ and sensitivity.

TABLE VI

| AgBZT Dispersion | vAg | $D_{min}$ | $D_{max}$ | Speed-1 | Speed-2 | ($D_{max} - D_{min}$) | Speed-2/$D_{min}$ |
|---|---|---|---|---|---|---|---|
| C (invention) | 0 mV | 0.256 | 2.657 | 5.219 | 4.812 | 2.401 | 18.80 |
| D (invention) | 50 mV | 0.247 | 2.712 | 5.236 | 4.848 | 2.465 | 19.63 |

Example 4

Thermographic Material

The following example demonstrates that rod-shaped nitrogen-containing heterocyclic compounds containing an imino group within the scope of the present invention can be used in thermographic materials.

A 20 cm×1 cm strip of thermographic material was prepared using the materials described in Example 2 (silver benzotriazole emulsion D) but without photosensitive silver bromoiodide emulsion (Solution B). The strip was heated on a Reichert Heizbank heating block system (Kofler Reichert, Austria) with a temperature gradient from 68° C. to 212° C. for 15 seconds. Densitometry measurements were carried out on an X-Rite® Model 301 densitometer. A development onset temperature of 168° C. was found. A Dmax optical density of 3.90 was obtained. The Dmin optical density remained at 0.172 at temperatures below 167° C.

Thus, thermographic materials containing rod-shaped silver salts of nitrogen-containing heterocyclic compounds containing an imino group can be used as the non-photosensitive source of reducible silver ions in thermographic materials, and are capable of providing images with excellent Dmin and Dmax.

The invention has been described in detail with particular reference to certain preferred embodiments thereof, but it will be understood that variations and modifications can be effected within the spirit and scope of the invention.

What is claimed is:

1. A thermally developable material comprising a support and having therein at least one thermally developable imaging layer comprising a hydrophilic polymer binder or a water-dispersible polymer latex binder and in reactive association:

a. a non-photosensitive source of reducible silver ions, and b. a reducing agent for said reducible silver ions, wherein said non-photosensitive source of reducible silver ions predominantly comprises rod-shaped particles of a silver salt of a nitrogen-containing heterocyclic compound containing an imino group, said rod-shaped particles having an average aspect ratio of at least 3:1 and a width index for particle diameter of 1.25 or less.

2. The material of claim 1 wherein said rod-shaped particles have a diameter less than or equal to 0.1 $\mu$m.

3. The material of claim 1 wherein said rod-like particles of said silver salt of a nitrogen-containing heterocyclic compound containing an imino group represent at least 70% by number of all particles of organic silver salts.

4. The material of claim 1 wherein said rod-like particles have a length that is less than 1 $\mu$m.

5. The material of claim 4 wherein said rod-like particles have a length of from about 0.1 to about 0.5 $\mu$m.

6. The material of claim 1 wherein said rod-like particles have an aspect ratio of from about 3 to about 10.

7. The material of claim 6 wherein said rod-like particles have an aspect ratio of from about 4 to about 7.5.

8. The material of claim 1 wherein said rod-like particles have a width index for particle diameter of from about 1.1 to about 1.2.

9. The material of claim 1 wherein rod-like particles are composed of silver salt of benzotriazole or a derivative thereof.

10. The material of claim 1 further comprising a photosensitive silver halide.

11. A black-and-white photothermographic material comprising a support and having therein at least one thermally developable imaging layer comprising a hydrophilic polymer binder or a water-dispersible polymer latex binder and in reactive association:

a. a photosensitive silver halide, b. a non-photosensitive source of reducible silver ions, and c. a reducing agent for said reducible silver ions, wherein said non-photosensitive source of reducible silver ions comprises particles of one or more organic silver salts provided that at least 70% by number of said particles are rod-shaped particles of a silver salt of a nitrogen-containing heterocyclic compound containing an imino group, said rod-shaped particles having an average aspect ratio of at least 3:1 and a width index for particle diameter of 1.25 or less.

12. The material of claim 11 wherein said hydrophilic polymer binder is gelatin, a gelatin derivative, or a cellulosic material.

13. The material of claim 11 wherein said reducing agent is an ascorbic acid, hindered phenol, or mixture thereof, and said rod-like particles of a silver salt of a nitrogen-containing heterocyclic compound are rod-like particles of a silver salt of benzotriazole or a derivative thereof.

14. The material of claim 11 wherein said rod-like particles have a length of from about 0.1 to about 0.5 $\mu$m, an aspect ratio of from about 3 to about 10, and a width index for particle diameter of from about 1.1 to about 1.2.

15. The material of claim 11 comprising one or more of the same or different thermally developable imaging layers on both sides of said support.

16. The material of claim 11 wherein said water-dispersible binder is a water-dispersible polymer latex.

17. A black-and-white photothermographic material comprising a support having on a frontside thereof, a) one or more frontside thermally developable imaging layers comprising a hydrophilic polymer binder or a water-dispersible polymer latex binder, and in reactive association, a photosensitive silver bromide, silver iodobromide, or a mixture thereof, b) a non-photosensitive source of reducible silver ions that includes a silver salt of benzotriazole or a derivative thereof, and c) a reducing agent for said non-photosensitive source reducible silver ions, said material comprising on the backside of said support, one or more backside thermally developable imaging layers having the same or different composition as said frontside thermally developable imaging layers, and d) optionally, an outermost protective layer disposed over said one or more thermally developable imaging layers on either or both sides of said support, and said silver salt of benzotriazole or a derivative thereof comprising rod-shaped particles that have a length of from about 0.1 to about 0.5 $\mu$m, a diameter less than 0.1 $\mu$m, an aspect ratio of from about 4 to about 7.5, and a width index for particle diameter of from about 1.1 to about 1.2.

18. The material of claim 17 having one or more of the same thermally developable imaging layers on both sides of said support, and said material is sensitive to electromagnetic radiation of from about 100 to about 700 nm.

19. A method of forming a visible image comprising:

A) imagewise exposing the photothermographic material of claim 11 to form a latent image, B) simultaneously or sequentially, heating said exposed photothermographic material to develop said latent image into a visible image.

20. The method of claim 19 wherein said thermally developable material comprises a transparent support, and said image-forming method further comprises:

C) positioning said exposed and thermally-developed material with the visible image therein between a source of imaging radiation and an imageable material that is sensitive to said imaging radiation, and D) exposing said imageable material to said imaging radiation through the visible image in said exposed and thermally-developed material to provide an image in said imageable material.

21. The method of claim 19 wherein said imagewise exposing is carried out using visible or X-radiation.

22. The method of claim 19 wherein said thermally developable material is arranged in association with one or more phosphor intensifying screens during imaging.

23. The method of claim 19 wherein said exposed photothermographic material is used for medical diagnosis.

24. A method of forming a visible image comprising:

A) imagewise exposing the photothermographic material of claim 17 to form a latent image, B) simultaneously or sequentially, heating said exposed photothermographic material to develop said latent image into a visible image.

25. An imaging assembly comprising the photothermographic material of claim 11 that is arranged in association with one or more phosphor intensifying screens.

26. A method of making particles of a silver salt of a nitrogen-containing heterocyclic compound containing an imino group, comprising:

A) preparing aqueous solution A of a nitrogen-containing heterocyclic compound containing an imino group, B) preparing aqueous solution B of silver nitrate, and C) simultaneously adding said aqueous solutions A and B to a reaction vessel containing an aqueous dispersion of a hydrophilic polymer binder or a water-dispersible polymer latex binder that has a pH of from about 7.5 to about 10, said simultaneous addition of said aqueous solutions A and B being carried out at constant flow rates $A_1$ and $B_1$, respectively, for up to 240 minutes, while maintaining a constant temperature of from about 30 to about 75° C., a constant pH, and a constant vAg equal to or greater than −50 mV in said reaction vessel, thereby preparing in said reaction vessel an organic silver salt dispersion of said hydrophilic polymer binder or said water-dispersible polymer latex binder and rod-shaped particles of a silver salt of said nitrogen-containing heterocyclic compound containing an imino group, said particles having an average aspect ratio of at least 3:1 and a width index for particle diameter of 1.25 or less, and said hydrophilic polymer binder or said water-dispersible polymer latex binder being present in said organic silver salt dispersion in an amount of from about 2 to about 10 weight %.

27. The method of claim 26 further comprising, after step C, the step of:

D) increasing the flow rate of the addition of solution B to said reaction vessel to $B_2$ for up to 60 minutes while maintaining constant temperature, pH, and vAg in said reaction vessel, wherein the ratio of said flow rate $B_2$ to said flow rate $B_1$ is from about 1.4:1 to about 1.8:1.

28. The method of claim 27 further comprising, after step D, the step of:

E) increasing the flow rate of the addition of solution B to said reaction vessel to $B_3$ for up to 60 minutes while maintaining constant temperature, pH and vAg in said reaction vessel, wherein the ratio of said flow rate $B_3$ to said flow rate $B_2$ is from about 1.8:1 to about 2.2:1.

29. The method of claim 26 wherein said nitrogen-containing heterocyclic compound containing an imino group is benzotriazole or a derivative thereof.

30. The method of claim 26 wherein the pH in said reaction vessel is maintained at from about 8 to about 9.5.

31. The method of claim 26 wherein said vAg is maintained in said reaction vessel at equal to or greater than 0 mV.

32. The method of claim 26 wherein the ratio of flow rate $A_1$ to total Ag moles precipitated is from about 0.004 to about 0.04 mol/min/mol Ag of imino group-containing compound per minute and the ratio of flow rate $B_1$ to total Ag moles precipitated is from about 0.004 to about 0.04 mol Ag/min/mol Ag.

33. The method of claim 26 wherein said hydrophilic polymer binder or said water-dispersible binder is present in said organic silver salt dispersion in an amount of from about 2 to about 10 weight %.

34. The method of claim 26 wherein said reaction vessel temperature is maintained at from about 35 to about 55° C.

35. The method of claim 26 wherein said rod-shaped silver salt particles have a width index for particle diameter of from about 1.1 to about 1.2 and an aspect ratio of from about 3 to about 10.

36. The method of claim 35 wherein said rod-shaped silver salt particles have an aspect ratio of from about 4:1 to about 7.5:1.

37. A method of making a silver salt of silver benzotriazole, comprising:

A) preparing aqueous solution A of benzotriazole,

B) preparing aqueous solution B of silver nitrate, and

C) simultaneously adding said aqueous solutions A and B to a reaction vessel containing an aqueous dispersion of gelatin or a gelatin derivative that has a pH of from about 8 to about 9.5, said simultaneous addition of said aqueous solutions A and B being carried out at constant flow rates $A_1$ and $B_1$, respectively, for up to 60 minutes, while maintaining a constant temperature of from about 40 to about 60° C., a constant pH, and a constant vAg that is greater than 0 mV in said reaction vessel, D) increasing the flow rate of the addition of said solution B to said reaction vessel to $B_2$ for up to 60 minutes while maintaining constant temperature, pH, and vAg in said reaction vessel, wherein the ratio of said flow rate $B_2$ to said flow rate $B_1$ is from about 1.4:1 to about 1.8:1, and E) subsequently increasing the flow rate of the addition of said solution B to said reaction vessel to $B_3$ for up to 60 minutes while maintaining constant temperature, pH and vAg in said reaction vessel, wherein the ratio of said flow rate $B_3$ to said flow rate $B_2$ is from about 1.8:1 to about 2.2:1, thereby preparing in said reaction vessel an organic silver salt dispersion of said gelatin or gelatin derivative and rod-shaped particles of silver benzotriazole having a width index for particle diameter of from about 1.1 to about 1.2, an average aspect ratio of from about 4:1 to about 7.5:1, and a diameter of less than or equal to 0.07 $\mu$m, and said gelatin or gelatin derivative being present in said organic silver salt dispersion in an amount of from about 2 to about 10 weight %.

38. An organic silver salt dispersion of a hydrophilic polymer binder or a water-dispersible polymer latex binder and rod-shaped particles of a non-photosensitive silver salt of a nitrogen-containing heterocyclic compound containing an imino group, said particles having an average aspect ratio of at least 3:1 and a width index for particle diameter of 1.25 or less, and said hydrophilic polymer binder or said water-dispersible polymer latex binder being present in said organic silver salt dispersion in an amount of from about 2 to about 10 weight %.

39. A non-photosensitive silver salt of a nitrogen-containing heterocyclic compound containing an imino group, said silver salt being in the form of rod-shaped particles having an average aspect ratio of at least 3:1, a width index for particle diameter of 1.25 or less, a diameter less than or equal to 0.1 $\mu$m, and a length that is less than 1 $\mu$m.

* * * * *